US012616278B2

(12) United States Patent
Ito et al.

(10) Patent No.: US 12,616,278 B2
(45) Date of Patent: May 5, 2026

(54) PLUG AND BUCKLE

(71) Applicant: YKK Corporation, Tokyo (JP)

(72) Inventors: Naoyuki Ito, Toyama (JP); Yohei Shimizu, Tokyo (JP); Hitoshi Kaneko, Toyama (JP); Kenichi Yoshie, Toyama (JP)

(73) Assignee: YKK Corporation, Tokyo (JP)

( * ) Notice: Subject to any disclaimer, the term of this patent is extended or adjusted under 35 U.S.C. 154(b) by 62 days.

(21) Appl. No.: 18/559,537

(22) PCT Filed: May 10, 2021

(86) PCT No.: PCT/JP2021/017697
§ 371 (c)(1),
(2) Date: Nov. 7, 2023

(87) PCT Pub. No.: WO2022/239062
PCT Pub. Date: Nov. 17, 2022

(65) Prior Publication Data

US 2024/0237787 A1 Jul. 18, 2024

(51) Int. Cl.
*A44B 11/25* (2006.01)
*A44B 11/26* (2006.01)

(52) U.S. Cl.
CPC ..... *A44B 11/263* (2013.01); *A44B 11/26* (2013.01); *Y10T 24/45529* (2015.01)

(58) Field of Classification Search
CPC ..... Y10T 24/45785; Y10T 24/45482; Y10T 24/45529; Y10T 24/45534; A44B 11/26;
(Continued)

(56) References Cited

U.S. PATENT DOCUMENTS 5,806,152 A * 9/1998 Saitou ..... A44B 11/266 24/651
2002/0092140 A1* 7/2002 Van Tassel ..... A44B 11/266 24/614
(Continued)

FOREIGN PATENT DOCUMENTS

CN 1535634 A 10/2004
CN 106539195 A 3/2017
(Continued)

OTHER PUBLICATIONS

International Preliminary Report on Patentability, PCT Patent Application No. PCT/JP2021/017697, Nov. 14, 2023, 5 pages.
(Continued)

*Primary Examiner* — Jason W San
*Assistant Examiner* — Michael S Lee
(74) *Attorney, Agent, or Firm* — Kilpatrick Townsend & Stockton LLP

(57) ABSTRACT

A plug and a socket constitute a buckle. The plug includes a plug base and a pair of legs. At least one of the pair of legs includes a first extension extending from the plug base in an insertion direction of the plug, a second extension extending from the first extension in an inward width direction of the plug, an engagement portion provided on the first extension or the second extension to be engageable with a to-be-engaged portion of the socket in a detachment direction of the plug, and an operation portion provided on the second extension. When a force in the detachment direction is applied on the operation portion, the first extension is elastically deformed in the width direction of the plug in such a manner that a position of the engagement portion shifts from an engagement position to a disengagement position with respect to the to-be-engaged portion.

7 Claims, 27 Drawing Sheets

(58) Field of Classification Search
CPC .. A44B 11/2592; A44B 11/263; A44B 11/266
See application file for complete search history.

(56) References Cited

U.S. PATENT DOCUMENTS

| | | | | |
|---|---|---|---|---|
| 2010/0313327 | A1* | 12/2010 | Anscher | F41H 1/02 2/102 |
| 2011/0030180 | A1* | 2/2011 | Parisi | A44B 11/2546 24/611 |
| 2011/0099776 | A1* | 5/2011 | Anscher | A44B 11/266 24/701 |
| 2012/0260474 | A1* | 10/2012 | Yoshie | A44B 11/266 24/642 |
| 2014/0173859 | A1* | 6/2014 | Anderson | A44B 11/266 24/598.1 |
| 2016/0150857 | A1* | 6/2016 | Botkus | A44B 11/2592 24/615 |
| 2017/0079383 | A1 | 3/2017 | Huang | |

FOREIGN PATENT DOCUMENTS

| | | | |
|---|---|---|---|
| JP | 2000-000106 | A | 1/2000 |
| JP | 2017-012230 | A | 1/2017 |
| WO | 2009/134608 | A1 | 11/2009 |
| WO | 2011/161801 | A1 | 12/2011 |
| WO | 2013/164888 | A1 | 11/2013 |
| WO | 2013/175634 | A1 | 11/2013 |
| WO | 2015/003904 | A1 | 1/2015 |

OTHER PUBLICATIONS

International Preliminary Report on Patentability, PCT Patent Application No. PCT/JP2021/017697, Nov. 24, 2023, 5 pages.
Office Action, Chinese Patent Application No. 202180098092.X, Aug. 16, 2025, 7 pages.
International Search Report, PCT Patent Application No. PCT/JP2021/017697, Jul. 6, 2021, 6 pages.
Written Opinion, PCT Patent Application No. PCT/JP2021/017697, Jul. 6, 2021, 4 pages.

* cited by examiner

PLUG AND BUCKLE

TECHNICAL FIELD

The present invention relates to a plug and a buckle.

BACKGROUND ART

A buckle including a plug and a socket that are detachably connected in order to connect string members has been used in various articles such as clothes, bags, shoes, and packages. Two types of buckles, specifically, a front release buckle and a side release buckle are known as such buckles.

For instance, Patent Literature 1 discloses a front release buckle including an engagement portion provided on an engagement piece of a plug and a to-be-engaged portion provided on a tongue-shaped portion of a socket, the engagement portion and the to-be-engaged portion being engaged to connect the plug and the socket. A cover is provided on a front side of the socket. When a user pushes the cover, the cover is swung to push the tongue-shaped portion to cause elastic deformation of the tongue-shaped portion, thereby disengaging the engagement portion from the to-be-engaged portion.

Patent Literature 2 discloses a side release buckle including engagement portions respectively provided on a pair of legs of a plug and to-be-engaged portions provided on a socket, the engagement portions and the to-be-engaged portions being engaged to connect the plug and the socket. The socket has holes for exposing the pair of legs. When a user pinches to push the pair of legs with fingers, the pair of legs are elastically deformed to come close to each other, so that the engagement portions and the to-be-engaged portions are disengaged from each other.

CITATION LIST

Patent Literature(s)

Patent Literature 1: International Publication No. WO 2013/164888

Patent Literature 2: International Publication No. WO 2013/175634

SUMMARY OF THE INVENTION

Problem(s) to be Solved by the Invention

The above-described side release buckle is more difficult to disengage than a front release buckle. Specifically, since exposed portions of the pair of legs (i.e. components to be operated on the side release buckle) are located on lateral surfaces of the buckle that are smaller in area than a front side of the buckle, it is difficult to stabilize a direction of a force applied on the pair of legs. The buckle possibly rolls over in a user's hand depending on an angle of the hand pinching the pair of legs, resulting in failure in the disengagement operation.

In contrast, the above-described front release buckle, whose cover (i.e. the component to be operated) is provided at the front side of the buckle, can be easily disengaged. However, the front release buckle is lower in strength than the side release buckle. For instance, since a dimension of the buckle in a thickness direction is usually smaller than a dimension of the buckle in a width direction, the tongue-shaped portion of the front release buckle, which is to be elastically deformed in the thickness direction of the buckle, is thinner and, consequently, lower in strength than the legs of the side release buckle that elastically deform in a width direction of the buckle.

An object of the invention is to provide a plug and a buckle that ensure a stable disengagement operation without lowering strengths thereof.

Means for Solving the Problem(s)

A plug according to an aspect of the invention is insertable into and detachable from a socket, the plug and the socket constituting a buckle, the plug including: a plug base; and a pair of legs connected to the plug base at respective positions mutually spaced apart in a width direction of the plug, in which at least one of the pair of legs includes: a first extension extending from the plug base in an insertion direction of the plug; a second extension extending from the first extension in an inward width direction of the plug; an engagement portion provided on the first extension or the second extension and being engageable with a to-be-engaged portion of the socket in a detachment direction of the plug; and an operation portion provided on the second extension, and, when a force in the detachment direction is applied on the operation portion, the first extension is elastically deformed in the width direction of the plug in such a manner that a position of the engagement portion shifts from an engagement position to a disengagement position with respect to the to-be-engaged portion.

In the plug of the above aspect of the invention, the operation portion to be a to-be-operated component is provided on the second extension that is located at an inner side in the width direction of the plug with respect to the first extension in each leg. Accordingly, in the buckle using the plug of the above aspect of the invention, since the operation portion can be located on a front or back side of the buckle in an operable manner, a disengagement operation can be stably performed.

Further, in the plug of the above aspect of the invention, since the first extensions of the legs are elastically deformed in the width direction of the plug as in legs of a plug of a typical side release buckle, the first extensions can be made thick. Accordingly, the buckle using the plug of the above aspect of the invention can exhibit a greater strength than that of the typical front release buckle.

Thus, the plug of the above aspect of the invention can provide a buckle capable of performing a stable disengagement operation without lowering the strength thereof.

In the plug according to the above aspect of the invention, each of the pair of legs includes the first extension, the second extension, the engagement portion, and the operation portion, and, when a force in the detachment direction is applied on the operation portion of each of the pair of legs, the first extensions of the pair of legs are mutually independently elastically deformed.

According to the above arrangement, a magnitude of a force necessary for the disengagement operation can be reduced as compared with an instance where a pair of legs are connected by a bridge or the like.

In the plug according to the above aspect of the invention, the operation portion of at least one of the pair of legs protrudes from the second extension in a thickness direction intersecting each of the insertion direction and the width direction of the plug.

According to the above arrangement, a user can more easily pinch the operation portion as compared with an operation portion not protruding, so that operability of the buckle can be enhanced.

In the plug according to the above aspect of the invention, each of the pair of legs includes the first extension, the second extension, the engagement portion, and the operation portion, and, when the plug is seen in the thickness direction, the operation portions of the pair of legs are arranged to be mutually overlapped.

According to the above arrangement, a user can easily pinch the operation portions of the pair of legs together, so that operability of the buckle can be enhanced.

In the plug according to the above aspect of the invention, each of the pair of legs includes the first extension, the second extension, the engagement portion, and the operation portion, and the operation portions of the pair of legs are arranged in parallel in the width direction of the plug.

According to the above arrangement, a user can operate the operation portions from at least one of a front side or a back side of the buckle.

A buckle according to another aspect of the invention includes: the above-described plug; and a socket which the plug is insertable into and detachable from, the socket has a socket body having a housing space in which the pair of legs are capable of being housed, the to-be-engaged portion being provided on the socket body, and with the socket body housing the pair of legs, the operation portion is operably exposed from the socket body.

The buckle according to the above aspect of the invention can achieve the same advantage(s) as those of the above-described plug of the invention.

In the buckle according to the above aspect of the invention, the socket body includes a front piece and a back piece facing each other across the housing space in a thickness direction intersecting each of the insertion direction and the width direction of the plug, and at least one of the front piece or the back piece has a slit for exposing the operation portion, the slit being cut in the insertion direction.

According to the above arrangement, since the operation portion can be disposed in the slit, the buckle can be made compact in size.

In the buckle according to the above aspect of the invention, the socket body includes a pair of lateral pieces facing each other across the housing space in the width direction of the plug, each of the lateral pieces having a hole for exposing the first extension.

According to the above arrangement, the buckle can be disengaged not only by operating the operation portion but also by pinching the exposed portions of the pair of legs by fingers as in typical side release buckles.

DESCRIPTION OF EMBODIMENT(S)

First Exemplary Embodiment

A first exemplary embodiment of the invention will be described below with reference to FIGS. 1 to 8.

Figure 1:
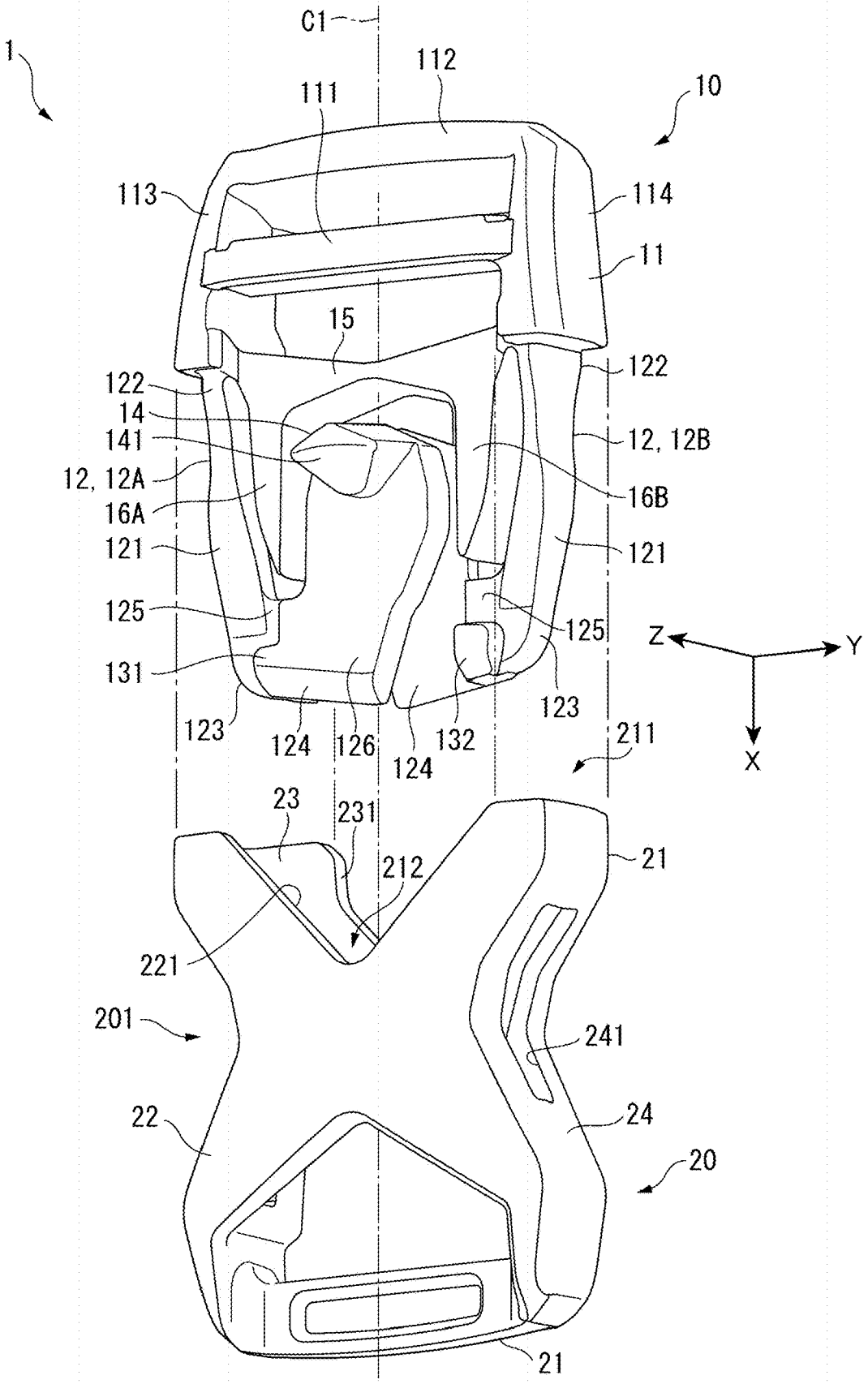
FIG. 1 is an exploded perspective view depicting a buckle according to a first exemplary embodiment of the invention.

As depicted in FIG. 1, a buckle 1 of the present exemplary embodiment includes a plug 10 and a socket 20 into which the plug 10 is insertable. Ends of a string member (e.g. belt, tape) are respectively attached to the plug 10 and the socket 20, so that the ends of the string member are connected to each other when the plug 10 is engaged with the socket 20.

Hereinbelow, an insertion direction of the plug 10 into the socket 20 will be referred to as an X direction, a width direction of the buckle 1 will be referred to as a Y direction, and a thickness direction of the buckle 1 (specifically, a direction from a back side to a front side of the buckle 1) will be referred to as a Z direction. The X, Y, and Z directions are orthogonal to each other. Further, a direction opposite the X direction (i.e. a detachment direction of the plug 10 from the socket 20) will be referred to as a −X direction and a direction opposite the Z direction (i.e. a direction from the front side to the back side of the buckle 1) will be referred to as a −Z direction. With regard to the Y direction, a direction toward a center line C1 of the plug 10 will be referred to an inward Y direction and a direction away from the center line C1 will be referred to as an outward Y direction.

Structure of Plug 10

Initially, a structure of the plug 10 will be described below with reference to FIGS. 1 to 5.

As depicted in FIGS. 1 to 5, the plug 10 includes a plug base 11 and a pair of legs 12A, 12B connected with the plug base 11.

The plug base 11 is provided with two stick-shaped members 111, 112 arranged along the Y direction and a pair of lateral pieces 113, 114 connected with the corresponding end of each of the two stick-shaped members 111, 112 in the Y direction. A gap into which the string member is insertable is present between the two stick-shaped members 111, 112, where the string member is wrapped around at least one of the stick-shaped members 111, 112, thereby being attached on the plug base 11.

The pair of legs 12A, 12B are respectively connected to the pair of lateral pieces 113, 114 of the plug base 11. Specifically, the pair of legs 12A, 12B are connected to the plug base 11 at positions mutually spaced in the Y direction across the center line C1 of the plug 10.

Figure 2:
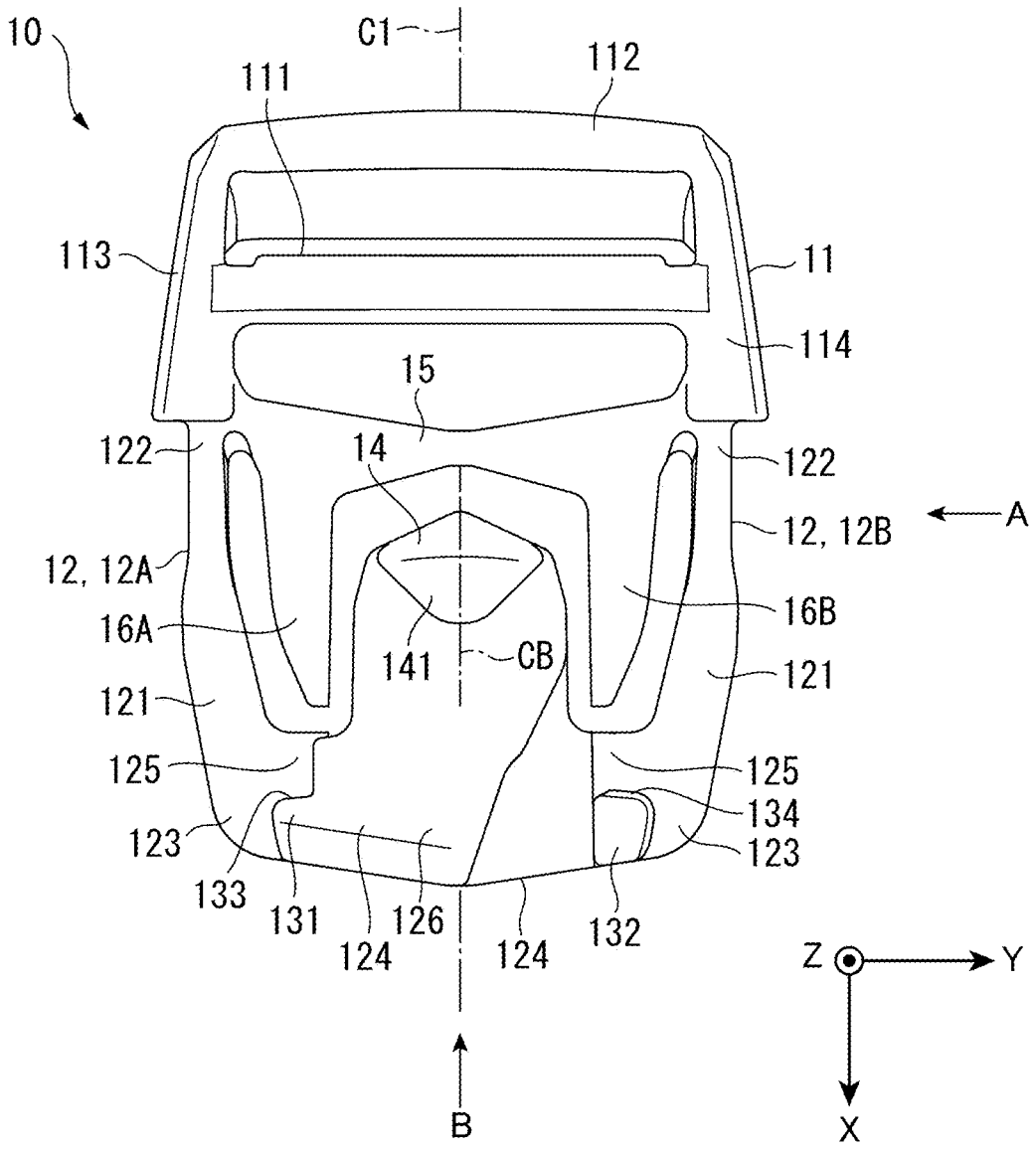
FIG. 2 is a front elevational view depicting a plug of the first exemplary embodiment.

Further, the pair of legs 12A, 12B are 180-degree rotationally symmetric around the center line C1 of the plug 10. For instance, supposing that the plug 10 depicted in FIG. 2 is turned over, the pair of legs 12A, 12B are identically illustrated only except that the reference numerals 12A, 12B are exchanged.

Each of the legs 12A, 12B will be sometimes simply referred to as a leg 12 hereinafter for the convenience of collective description.

The leg 12 includes a first extension 121 extending from the plug base 11 in the X direction, a second extension 124 extending from the first extension 121 in the inward Y direction, and engagement portions 131, 132 and an operation portion 14 provided on the second extension 124.

Figure 3:
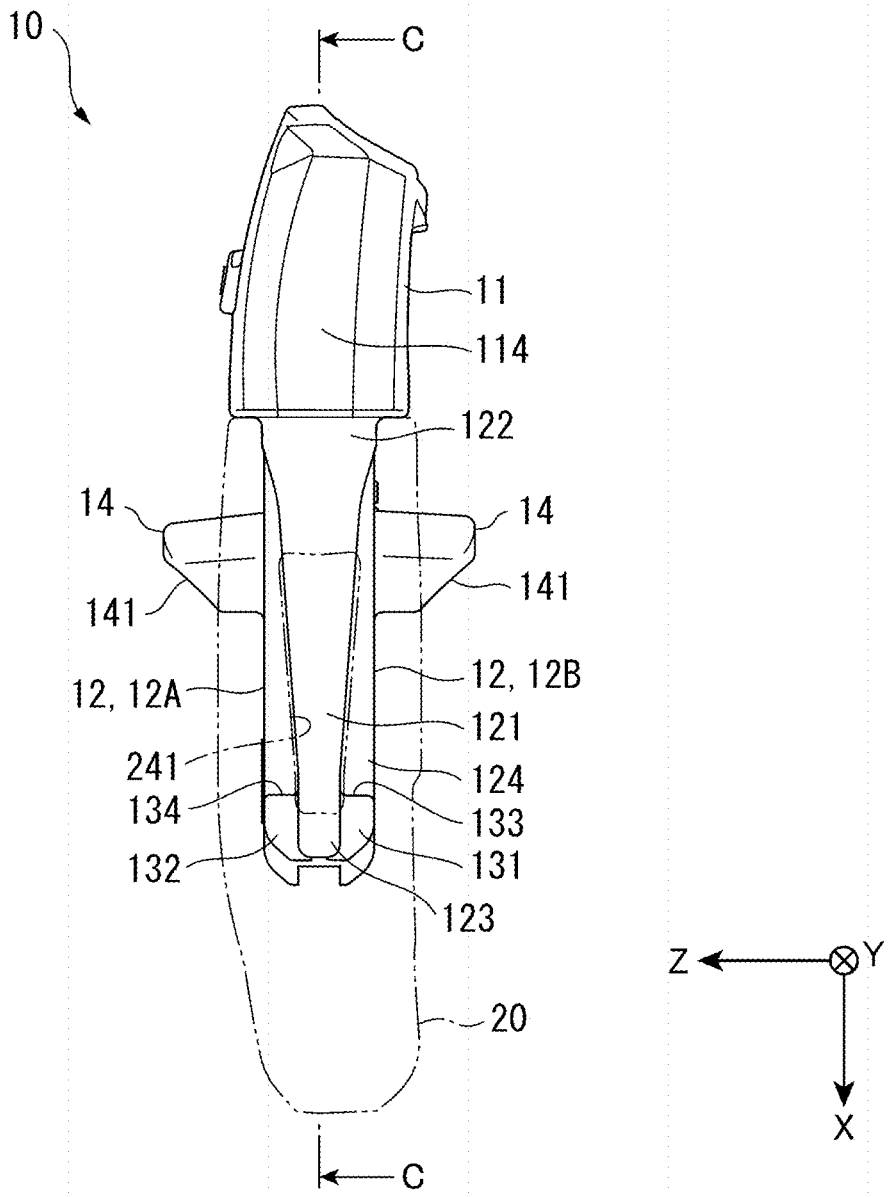
FIG. 3 is a side elevational view depicting the plug of the first exemplary embodiment seen in a direction of an arrow A in FIG. 2.

The first extension 121, which extends in the X direction from a base end portion 122 to a distal end portion 123, is of a tapered shape whose thickness in the Z direction gradually decreases from the base end portion 122 to the distal end portion 123 (see FIG. 3). Further, the width of the first extension 121 in the Y direction is smaller at a portion near the base end portion 122 than at a portion near the distal end portion 123, so that the portion near the base end portion 122 is elastically deformable in the Y direction. It should be noted that the profiles of the first extension 121 before and after being elastically deformed are illustrated in dash-dotted lines and solid lines in FIG. 5, respectively.

The second extension 124 includes a base end 125 connected to an inward Y-direction side of the distal end portion 123 of the first extension 121 and a plate portion 126 extending from the base end 125 in the inward Y direction and in the −X direction.

Figure 4:
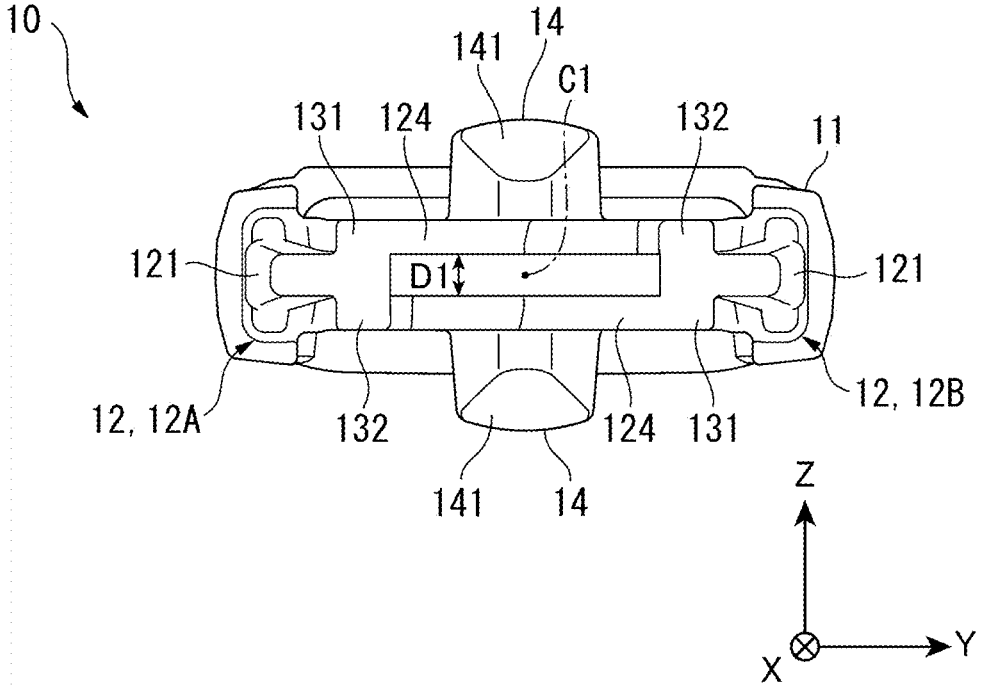
FIG. 4 is a side elevational view depicting the plug of the first exemplary embodiment seen in a direction of an arrow B in FIG. 2.

The plate portion 126 of the leg 12A and the plate portion 126 of the leg 12B are arranged to be partially overlapped with each other in the Z direction across a gap D1 (see FIG. 4). For instance, the plate portion 126 of the leg 12A and the plate portion 126 of the leg 12B in the present exemplary embodiment are located at a front side and a back side of the plug 10, respectively. The dimension of the gap D1, which is not especially limited, may be defined as desired as long as mutual interference between the plate portions 126 do not occur.

Further, a gap is present in the Y direction between the legs 12A, 12B for allowing a movement of each of the second extensions 124 in the inward Y direction.

The engagement portions 131, 132, which are provided near an end of the second extension 124 in the X direction, protrude in the Z or −Z direction.

For instance, the engagement portion 131 of the leg 12A in the present exemplary embodiment protrudes in the Z direction and the engagement portion 132 of the leg 12A protrudes in the −Z direction. Further, the engagement portion 131 of the leg 12B protrudes in the −Z direction and the engagement portion 132 of the leg 12B protrudes in the Z direction.

The engagement portions 131, 132 are respectively provided with engaging surfaces 133, 134 facing the −X direction and are capable of being brought into contact with a to-be-engaged portion 243 of the later-described socket 20 in the X direction.

The operation portion 14 is provided on the second extension 124 to be operably exposed through a later-described socket body 201 and receives an operation by a user.

The operation portion 14 in the present exemplary embodiment is provided near an end (in the −X direction) of the plate portion 126 of the second extension 124 to protrude from the plate portion 126 in the Z (or −Z) direction. Specifically, the operation portion 14 of the leg 12A protrudes from the second extension 124 toward the front side of the plug 10 (i.e. in the Z direction). The operation portion 14 of the leg 12B protrudes from the second extension 124 toward the back side of the plug 10 (i.e. in the −Z direction).

Further, a slant surface 141, which is slanted in the Z direction to increase a projection height from the second extension 124 toward the −X direction, is provided on the operation portion 14 to face the X direction.

When the plug 10 is seen in the Z direction, the operation portions 14 of the legs 12A, 12B are overlapped with each other and with the center line C1 of the plug 10.

Especially, the operation portion 14 of the present exemplary embodiment has a symmetrical shape with respect to a virtual plane CB that is parallel to the X and Z directions. This virtual plane CB overlaps the center line C1 of the plug 10 when the plug 10 and the socket 20 are not connected (see FIG. 2).

The plug 10 of the present exemplary embodiment further includes a connecting portion 15 connected to the plug base 11 and a pair of auxiliary legs 16A, 16B connected to the connecting portion 15.

The connecting portion 15 connects a pair of lateral pieces 113, 114 with a gap from the stick-shaped member 111 of the plug base 11.

The pair of auxiliary legs 16A, 16B are connected to an X-direction side of the connecting portion 15. Further, the pair of auxiliary legs 16A, 16B are respectively located in the inward Y direction with respect to the pair of legs 12A, 12B, extending from the connecting portion 15 in the X direction. Specifically, the auxiliary leg 16A is located in the gap formed between the first extension 121 and the second extension 124 of the leg 12A and the auxiliary leg 16B is located in the gap formed between the first extension 121 and the second extension 124 of the leg 12B.

Here, the connecting portion 15 and the auxiliary legs 16A, 16B are spaced apart from the legs 12A, 12B by a predetermined gap to prevent excessive elastic deformation of the legs 12A, 12B.

Figure 8:
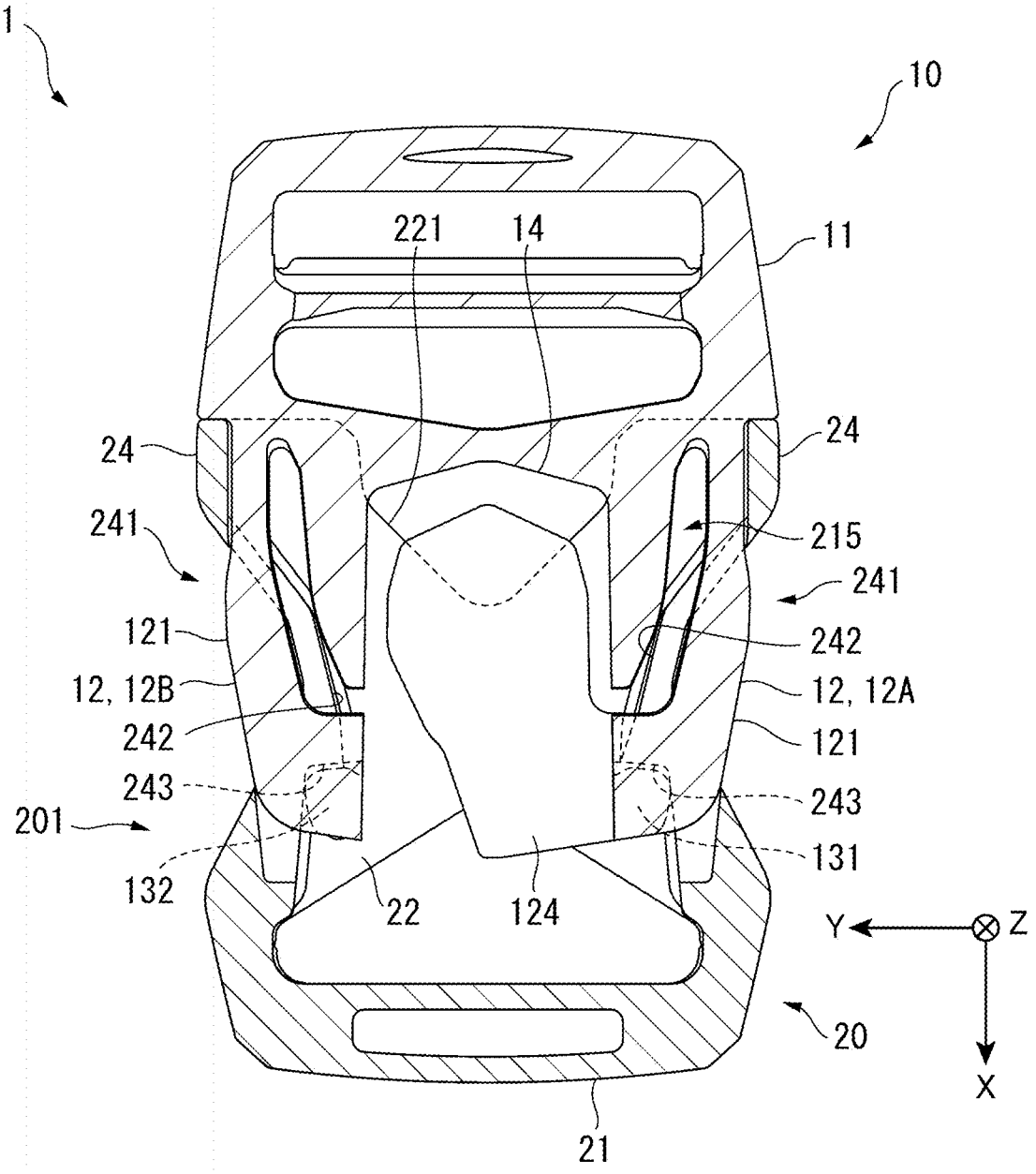
FIG. 8 is a cross-sectional view depicting the buckle of the first exemplary embodiment cut along C-C lines in FIG. 3.

Further, with the plug 10 and the socket 20 being connected to each other, the auxiliary legs 16A, 16B are in contact with an interior surface of the socket 20 to enhance the rigidity of the buckle 1 (see FIG. 8).

It should be noted that the plug 10 of the present exemplary embodiment has no guide piece at the center in the Y direction, unlike plugs of typical side release buckles.

Figure 5:
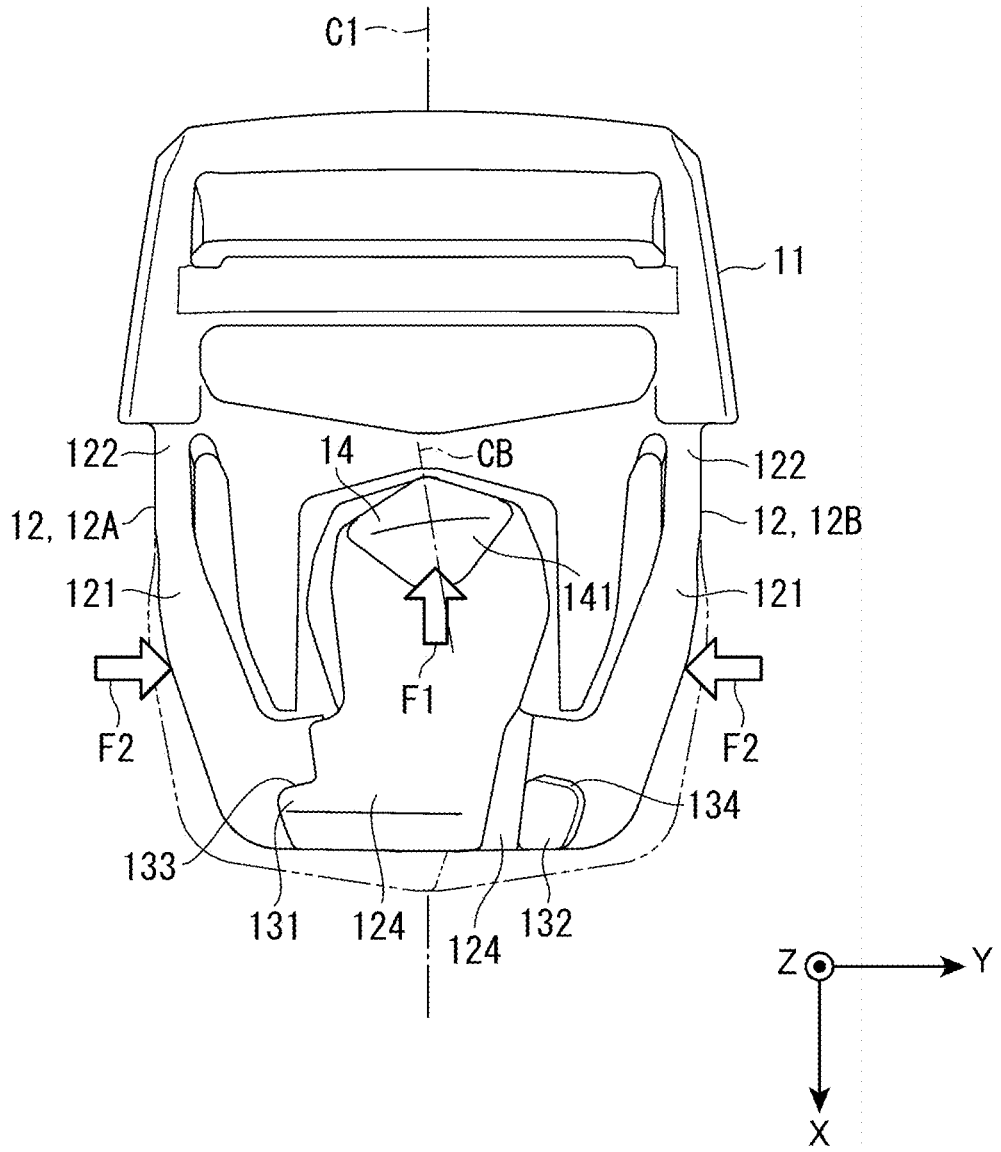
FIG. 5 depicts deformed legs of the plug of the first exemplary embodiment.
Figure 6:
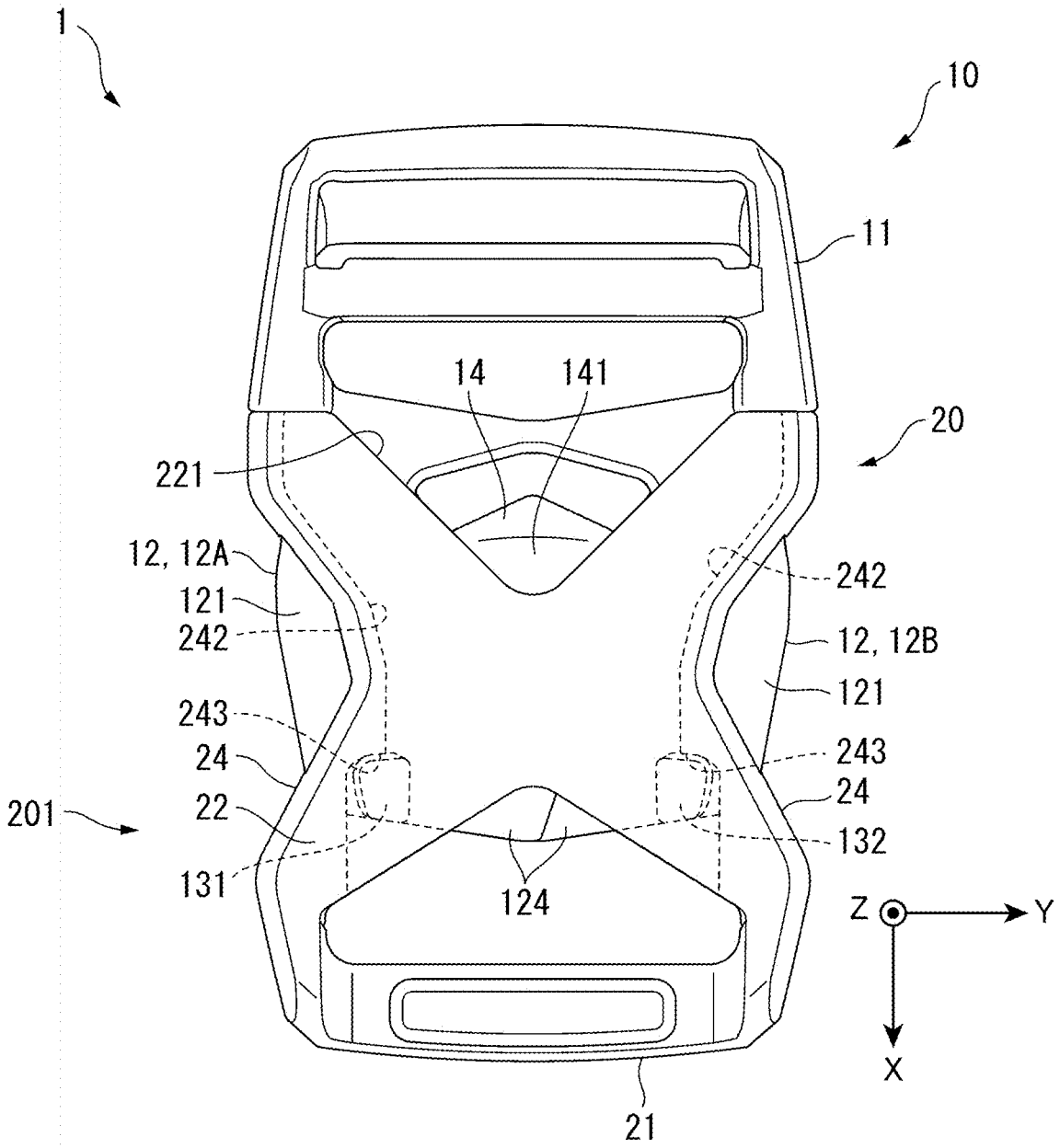
FIG. 6 is a front elevational view depicting the buckle of the first exemplary embodiment.

In order to disconnect the above-described plug 10 from the socket 20, an operation for applying a force F1 in the −X direction is performed on the operation portion 14 or an operation for applying a force F2 in the inward Y direction is performed on the first extension 121 (see FIG. 5).

When the force F1 in the −X direction is applied on the operation portion 14 or when the force F2 in the inward Y direction is applied on the first extension 121, the first extension 121 is elastically deformed in the inward Y direction to displace the engagement portions 131, 132 in the inward Y direction. Accordingly, the position of each of the engagement portions 131, 132 shifts from an engagement position to a disengagement position with respect to the to-be-engaged portion 243 of the socket 20.

It should be noted that, due to a swing movement of the second extension 124 when the first extension 121 is elastically deformed, the virtual plane CB (i.e. symmetric center of the operation portion 14), which is overlapped with the center line C1 of the plug 10, becomes slanted with respect to the center line C1 of the plug 10.

Structure of Socket 20

Next, a structure of the socket 20 will be described below with reference to FIGS. 1 and 6 to 8.

The socket 20 includes: the socket body 201 into which the pair of legs 12A, 12B of the above-described plug 10 are insertable; and a stick-shaped member 21 arranged along the Y direction and connected with the socket body 201 at both ends thereof. A gap into which a string member is insertable is present between the socket body 201 and the stick-shaped member 21. The string member is wrapped around the stick-shaped member 21 to be attached to the socket 20.

The socket body 201 is a tubular component arranged along the X direction. Specifically, an insertion hole 211 for receiving the plug 10 is formed at a −X-direction end (i.e. an end in the −X direction) of the socket body 201 and a housing space 212 in communication with the insertion hole 211 is formed inside the socket body 201. In the housing space 212, the pair of legs 12 of the plug 10 inserted through the insertion hole 211 can be housed.

The socket body 201 includes a front piece 22, a back piece 23, and a pair of lateral pieces 24. The front piece 22 and the back piece 23 are flat plates arranged along X and Y directions, facing each other in the Z direction across the housing space 212. The pair of lateral pieces 24 are arranged to face each other in the Y direction across the housing space 212 to connect both Y-direction ends (i.e. ends in the Y direction) of the front piece 22 and the back piece 23.

It should be noted that the socket body 201 is 180-degree rotationally symmetric around a center line of the socket 20 (coincident with the center line C1 of the plug 10 when the socket and the plug are connected) except for the shape of a part of the front piece 22 and the back piece 23.

The front piece 22 is provided with a slit 221 defined in a form of a cut at a −X-direction end (i.e. end in the −X-direction) toward the X direction. Similarly, the back piece 23 is provided with a slit 231 in a form of a cut at a −X-direction end toward the X direction. The peripheral portions of the slits 221, 231 are shaped to conform to the shape of an X-direction end (i.e. end in the X-direction) of the operation portion 14.

When the plug 10 and the socket 20 are connected, the operation portion 14 of the leg 12A is located in the slit 221 of the front piece 22 and the operation portion 14 of the leg 12B is located in the slit 231 of the back piece 23. At this time, the operation portion 14 is in contact with the peripheral portion of the corresponding one of the slits 221, 231.

Each of the pair of lateral pieces 24 is curved to be dented in the inward Y direction. A hole 241 in communication with the housing space 212 is formed at the dented portion of each of the lateral pieces 24. The hole 241 has a larger width in the Z direction than the width of the first extension 121 and has a predetermined length in the X direction. When the plug 10 and the socket 20 are connected, a lateral surface of the first extension 121 in the outward Y direction is exposed through the hole 241 to an outside of the socket body 201.

An inner surface of each of the lateral pieces 24 defines a guide surface 242 continuous in the X direction at both of Z-direction and −Z-direction sides with respect to the hole 241. The guide surface 242 guides the engagement portions 131, 132 of the leg 12 toward the to-be-engaged portions 243 described below.

Two to-be-engaged portions 243 corresponding one-to-one to the engagement portions 131, 132 of the leg 12 are formed on the inner surfaces of the lateral pieces 24. Specifically, each to-be-engaged portion 243 facing the X direction is formed on the inner surface of each lateral piece 24 at an X-direction side of the guide surface 242.

When the plug 10 and the socket 20 are connected, the to-be-engaged portion 243 is in contact with the engaging surface 133 (or 134) of the engagement portion 131 (or 132) of the leg 12.

Figure 7:
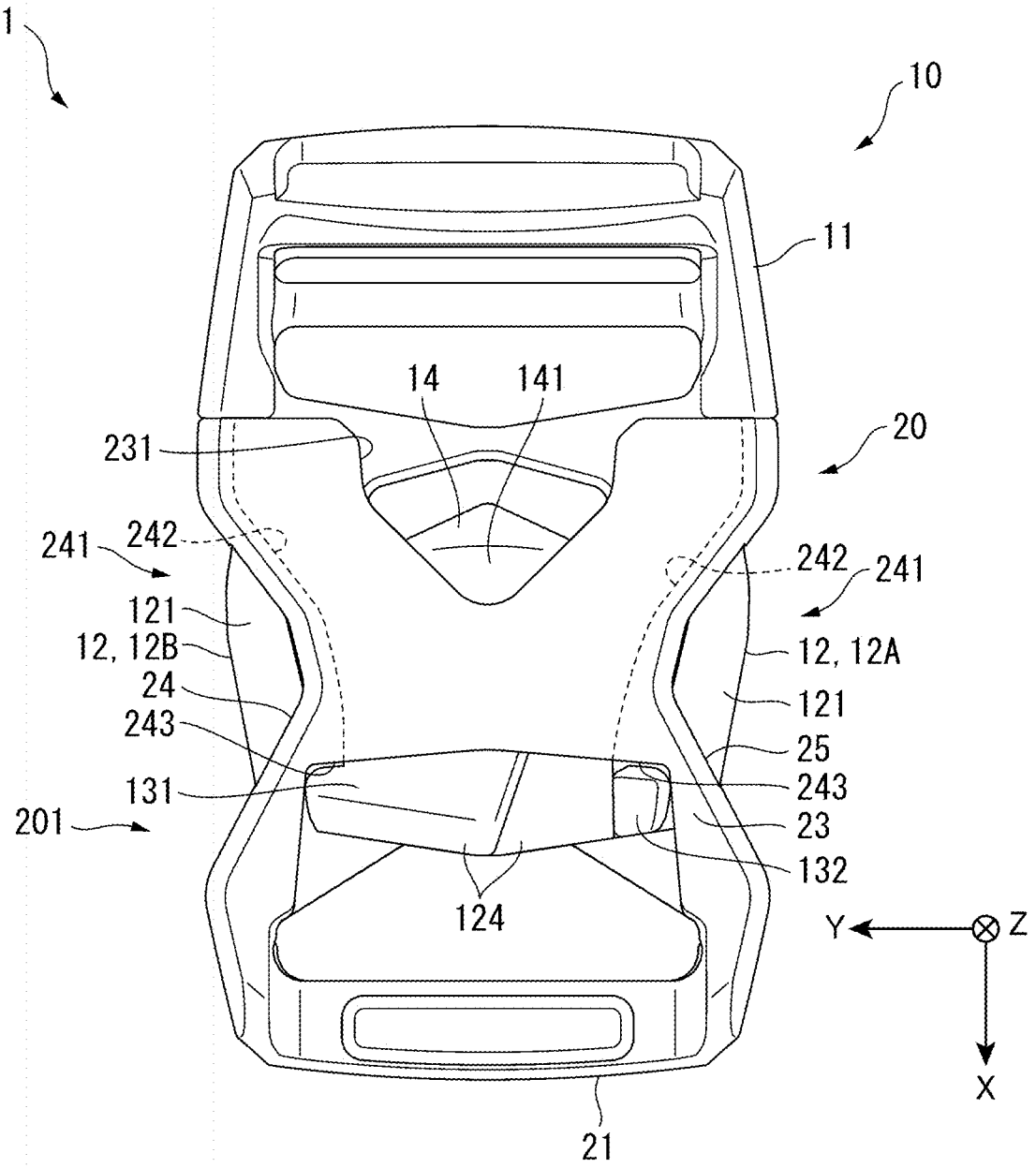
FIG. 7 is a rear elevational view depicting the buckle of the first exemplary embodiment.

It should be noted that, while the front piece 22 covers the to-be-engaged portion 243 located at the front side of the buckle 1 (see FIG. 6), the back piece 23 does not cover the to-be-engaged portion 243 located at the back side of the buckle 1 (see FIG. 7). Accordingly, while the plug 10 and the socket 20 are connected, the engagement portion 131 engaged with the to-be-engaged portion 243, which is covered with the front piece 22 when the buckle 1 is seen from the front side, can be seen when the buckle 1 is viewed from the back side.

Connecting and Disconnecting Plug 10 and Socket 20

In order to connect the plug 10 and the socket 20, with the plug 10 and the socket 20 being aligned to face each other as shown in FIG. 1, a user inserts the plug 10 into the socket 20 through the insertion hole 211.

When the leg 12 advances within the socket 20 in the X direction, the engagement portions 131, 132 of the leg 12 are guided by the guide surface 242 of the lateral piece 24 (see FIG. 8). Since the guide surface 242 of each of the lateral pieces 24 is curved in the inward Y direction while extending in the X direction, the first extension 121 receives pressure from the guide surface 242 via the engagement portions 131, 132 to be elastically deformed in the inward Y direction. Then, when the engagement portions 131, 132 reach the to-be-engaged portions 243, the elastically deformed first extension 121 is restored to its original shape, so that the engagement portions 131, 132 are located at the engagement position, where the engagement portions 131, 132 are in contact with the to-be-engaged portions 243. The plug 10 is thus restricted from being moved in the −X direction (i.e. dropping off) to connect the plug 10 and the socket 20.

In the present exemplary embodiment, there are two options for an operation method for disconnecting (i.e. releasing the connection between) the plug 10 and the socket 20.

In a first operation method, a user pinches the operation portions 14 of the pair of legs 12 from both sides in the Z direction and pulls the operation portions 14 in the −X direction. The force F1 (see FIG. 5) in the −X direction is thus applied on the operation portions 14, so that the first extensions 121 of the pair of legs 12 are elastically deformed in the inward Y direction to disengage the engagement portions 131, 132 of each of the legs 12 from the to-be-engaged portion 243. Then, the plug 10 is moved in the −X direction to be detached from the socket 20.

The first operation method is provided as a new operation method that is different from the operation method for the typical front release buckle and side release buckle.

In a second operation method, a user pushes out the first extensions 121 of the pair of legs 12 in the −X direction while pressing the first extensions 121 in the inward Y direction. At this time, the force F2 (see FIG. 5) in the Y direction is applied on the first extensions 121, so that the first extensions 121 are elastically deformed in the inward Y direction to disengage the engagement portions 131, 132 of each of the legs 12 from the to-be-engaged portions 243. Then, the plug 10 is moved in the −X direction to be detached from the socket 20.

The second operation method is the same as the operation method for tye typical side release buckle.

It should be noted that, as described above, since the leg 12 of the plug 10 and the socket body 201 are each 180-degree rotationally symmetric around the center line, the plug 10 can be connected to and disconnected from the socket 20 even when the plug 10 is turned over.

Advantage(s) of First Exemplary Embodiment

Each operation portion 14 to be the to-be-operated component of the plug 10 of the present exemplary embodiment is provided on each of the second extensions 124 that are located at an inner side in the width direction of the plug 10 with respect to the first extensions 121 of the leg 12. Accordingly, the buckle 1 using the plug 10 of the present exemplary embodiment, whose operation portion 14 can be arranged on the front or back side of the buckle 1 in an operable manner, allows the disengagement operation to be stably performed.

Further, in the plug 10 of the present exemplary embodiment, the first extension 121 of the leg 12, which elastically deforms in the width direction of the plug 10 as in the leg of the plug of the typical side release buckle, can be provided in a form of a thick component. Accordingly, the buckle 1 using the plug 10 of the present exemplary embodiment can exhibit a greater strength than that of the typical front release buckle.

Thus, the plug 10 of the present exemplary embodiment can provide the buckle 1 capable of performing a stable disengagement operation without lowering the strength thereof.

Further, in the present exemplary embodiment, the pair of legs 12 each include the first extension 121, the second extension 124, and the engagement portions 131, 132. The first extensions 121 of the pair of legs 12 are each independently elastically deformable when the force in the detachment direction is applied on each of the operation portions 14. In other words, though the plug 10 of the present exemplary embodiment is disengageable from the socket body 201 when the force is applied on both of the two operation portions 14, the plug 10 is not completely disengaged from the socket body 201 when a force unexpected by the user is applied on only one of the operation portions 14. The safety during the use of the plug 10 can thus be enhanced.

Some of typical buckles are configured to effect a disengagement operation by pulling a strap whose end is fixed to a bridge or the like connecting end portions of a pair of legs (for instance, see International Publication No. WO 2009/134608). Such a buckle requires a force for elastically deforming the bridge between the pair of legs at the time of the disengagement operation in addition to the force for elastically deforming the pair of legs.

In contrast, as described above, the first extensions 121 of the pair of legs 12 are mutually independently elastically deformed in the present exemplary embodiment. In other words, the present exemplary embodiment, where the bridge is not provided unlike the related art and it is thus not necessary to elastically deform the bridge, can reduce the force required for the disengagement operation.

In the present exemplary embodiment, since the operation portions 14 protrude in the Z direction (or −Z direction), a user can easily pinch the operation portions 14, so that the operability of the buckle 1 can be improved.

For instance, as compared with the above-described typical buckle using the strap, the buckle of the present exemplary embodiment, where it is not necessary to insert a finger into an inside of a ring of the strap and grope for the ring of the strap, can be easily operated.

When the plug 10 according to the present exemplary embodiment is seen in the Z direction, the operation portions 14 of the pair of legs 12 are arranged to be mutually overlapped. Accordingly, a user can easily pinch the operation portions 14 of the pair of legs 12 together, so that the operability of the buckle 1 can be enhanced.

The buckle 1 of the present exemplary embodiment includes the above-described plug 10 and the socket 20, in which the operation portions 14 are operably exposed from the socket body 201 when the pair of legs 12 are housed within the socket body 201. The buckle 1 achieves the above-described advantages of the plug 10.

In the present exemplary embodiment, the operation portions 14 are exposed from the socket body 201 through the slits 221, 231 cut into the socket body 201. According to the above arrangement, since the operation portions 14 can be disposed in the slits 221, 231, the buckle 1 can be made compact in size.

In the present exemplary embodiment, the pair of legs 12 are exposed through the holes 241 provided on the pair of lateral pieces 24 of the socket body 201. Accordingly, the buckle 1 of the present exemplary embodiment can be disengaged not only by operating the operation portions 14 but also by pinching the exposed portions of the pair of legs 12 by fingers as in typical side release buckles.

Further, each leg 12 of the present exemplary embodiment is provided with the two engagement portions 131, 132 respectively protruding in the Z direction and the −Z direction. In other words, the plug 10 according to the present exemplary embodiment is provided with two pairs (i.e. total four) of engagement portions 131, 132. The connection strength of the plug 10 with the socket 20 can thus be further enhanced.

Second Exemplary Embodiment

Next, a second exemplary embodiment of the invention will be described below with reference to FIGS. 9 to 15.

As depicted in FIG. 1, a buckle 1A of the present exemplary embodiment includes a plug 30 and a socket 40 into which the plug 30 is insertable. The buckle 1A is different from the first exemplary embodiment mainly in terms of an engagement structure of the plug 30 and the socket 40. Description on the same or similar components as those in the first exemplary embodiment will be sometimes omitted hereinbelow.

A structure of the plug 30 will be described below with reference to FIGS. 9 to 13.

As shown in FIGS. 9 to 13, the plug 30 includes the plug base 11 similar to the first exemplary embodiment and a pair of legs 32A, 32B connected to the plug base 11.

The pair of legs 32A, 32B are respectively connected to the pair of lateral pieces 113, 114 of the plug base 11. Specifically, the pair of legs 32A, 32B are connected to the plug base 11 at positions mutually spaced in the Y direction across a center line C2 of the plug 30.

Further, the pair of legs 32A, 32B are 180-degree rotationally symmetric around the center line C2 (see FIG. 9) of the plug 30. For instance, supposing that the plug 30 depicted in FIG. 10 is turned over, the pair of legs 32A, 32B are identically illustrated only except that the reference numerals 32A, 32B are exchanged.

Each of the legs 32A,32B will be sometimes simply referred to as a leg 32 hereinafter for the convenience of collective description.

The leg 32 includes a first extension 321 extending from the plug base 11 in the X direction, a second extension 324 extending from the first extension 321 in the inward Y direction, an engagement portion 33 provided on the first extension 321, and an operation portion 34 provided on the second extension 324.

The first extension 321 extends from a base end portion 322 to a distal end portion 323 along the X direction. Further, the width of the first extension 321 in the Y direction is smaller at a portion near the base end portion 322 than at a portion near the distal end portion 323 so that the portion near the base end portion 322 is elastically deformable in the Y direction. It should be noted that the profiles of the first extension 321 before and after being elastically deformed are illustrated in dash-dotted lines and solid lines in FIG. 13, respectively.

The engagement portion 33 is in a form of a stepped portion with respect to a lateral side of the first extension 321 in the outward Y direction. The engagement portion 33 is provided with an engaging surface 331 facing the −X direction and is capable of being brought into contact with a to-be-engaged portion 443 of the later-described socket 40 in the X direction.

It should be noted that a reinforcing portion 332 is provided to the stepped engagement portion 33 at the lateral side of the first extension 321 in the present exemplary embodiment The second extension 324, which is configured substantially in the same manner as the second extension 124 of the first exemplary embodiment, includes a base end portion 325 connected to an inward Y-direction side of the distal end portion 323 of the first extension 321 and a plate portion 326 extending from the base end portion 325 in the inward Y direction and in the −X direction. The plate portion 326 of the leg 32A and the plate portion 326 of the leg 32B are arranged to be partially overlapped in the Z direction across a gap D2 (see FIG. 12).

The operation portion 34, which is provided on the second extension 324 of the leg 32 to be operably exposed through a later-described socket body 401 and is operable by a user, is arranged substantially in the same manner as the operation portion 14 of the first exemplary embodiment. Specifically, the operation portion 34 is provided at a −X-direction end (i.e. an end in the −X direction) of the plate portion 326 of the second extension 324 to protrude from the plate portion 326 in the Z (or −Z) direction, and has a slant surface 341 slanted in the Z direction and facing the X direction.

In order to disconnect the above-described plug 30 from the socket 40, an operation for applying a force F1 in the −X direction is performed on the operation portion 34 or an operation for applying a force F2 in the inward Y direction is performed on the first extension 321 of the above-described plug 30 (see FIG. 13) as in the first exemplary embodiment.

When the force in the −X direction is applied on the operation portion 34 or when the force in the inward Y direction is applied on the first extension 321, the first extension 321 is elastically deformed in the inward Y direction to displace the engagement portion 33 in the inward Y direction. Accordingly, the position of the engagement portion 33 shifts from an engagement position to a disengagement position of the socket 40 with respect to the to-be-engaged portion 443.

It should be noted that the virtual plane CB (symmetric center of the operation portion 34), which is overlapped with the center line C2 of the plug 30 at the engagement position, is displaced to be slanted with respect to the center line C2 of the plug 30.

Structure of Socket 40

Next, a structure of the socket 40 will be described below with reference to FIGS. 9. 14, and 15.

The socket 40 includes the socket body 401, into which the pair of legs 32A, 32B of the plug 30 are inserted, and the same stick-shaped member 21 as that in the first exemplary embodiment.

The socket body 401 is arranged substantially in the same manner as the socket body 201 of the first exemplary embodiment except for the engagement structure with the plug 30.

Specifically, the socket body 401 includes a front piece 42, a back piece 43, and a pair of lateral pieces 44. An insertion hole 411 for receiving the plug 30 is formed at a −X-direction end of the socket body 401 and a housing space 412 in communication with the insertion hole 411 is formed inside the socket body 401. In the housing space 412, the pair of legs 32 of the plug 30 inserted through the insertion hole 411 can be housed.

It should be noted that, since the shape of the front piece 42 and the shape of the back piece 43 of the socket body 401 are identical in the present exemplary embodiment, a back elevation of the buckle 1A is omitted.

The front piece 42 and the back piece 43 are respectively provided with slits 421, 431 defined in a form of a cut at a −X-direction end toward the X direction.

When the plug 30 and the socket 40 are connected, the operation portion 34 of the leg 32A is located in the slit 421 of the front piece 42 and the operation portion 34 of the leg 32B is located in the slit 431 of the back piece 43. At this time, the operation portion 34 is in contact with the peripheral portion of the corresponding one of the slits 421, 431.

Each of the pair of lateral pieces 44 is curved to be dented in the inward Y direction. A hole 441 in communication with the housing space 412 is formed at the dented portion of each of the lateral pieces 44. A part of a peripheral portion of the hole 441 of each of the lateral pieces 44 defines the to-be-engaged portion 443 facing the X direction. Further, a guide surface 442 for guiding the first extension 321 is formed at the −X-direction side of the hole 441 on the inner surface of each of the lateral pieces 44.

When the plug 30 and the socket 40 are connected, a lateral surface of the first extension 321 in the outward Y direction is exposed through the hole 441 to an outside of the socket body 401, where the to-be-engaged portion 443 is in contact with the engagement portion 33 of the leg 32 in the X direction.

Connecting and Disconnecting Plug 30 and Socket 40

Figure 9:
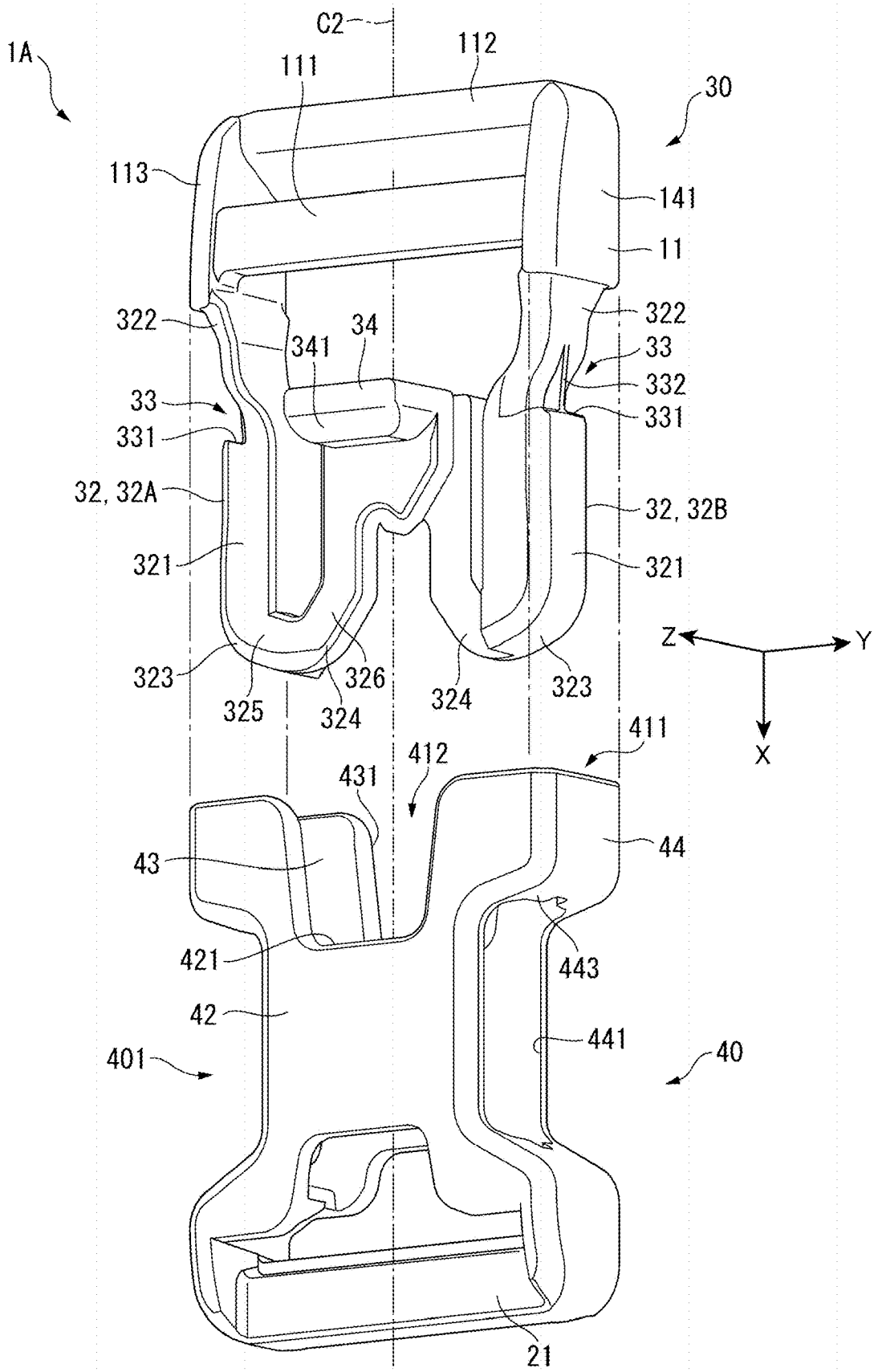
FIG. 9 is an exploded perspective view depicting a buckle according to a second exemplary embodiment of the invention.
Figure 10:
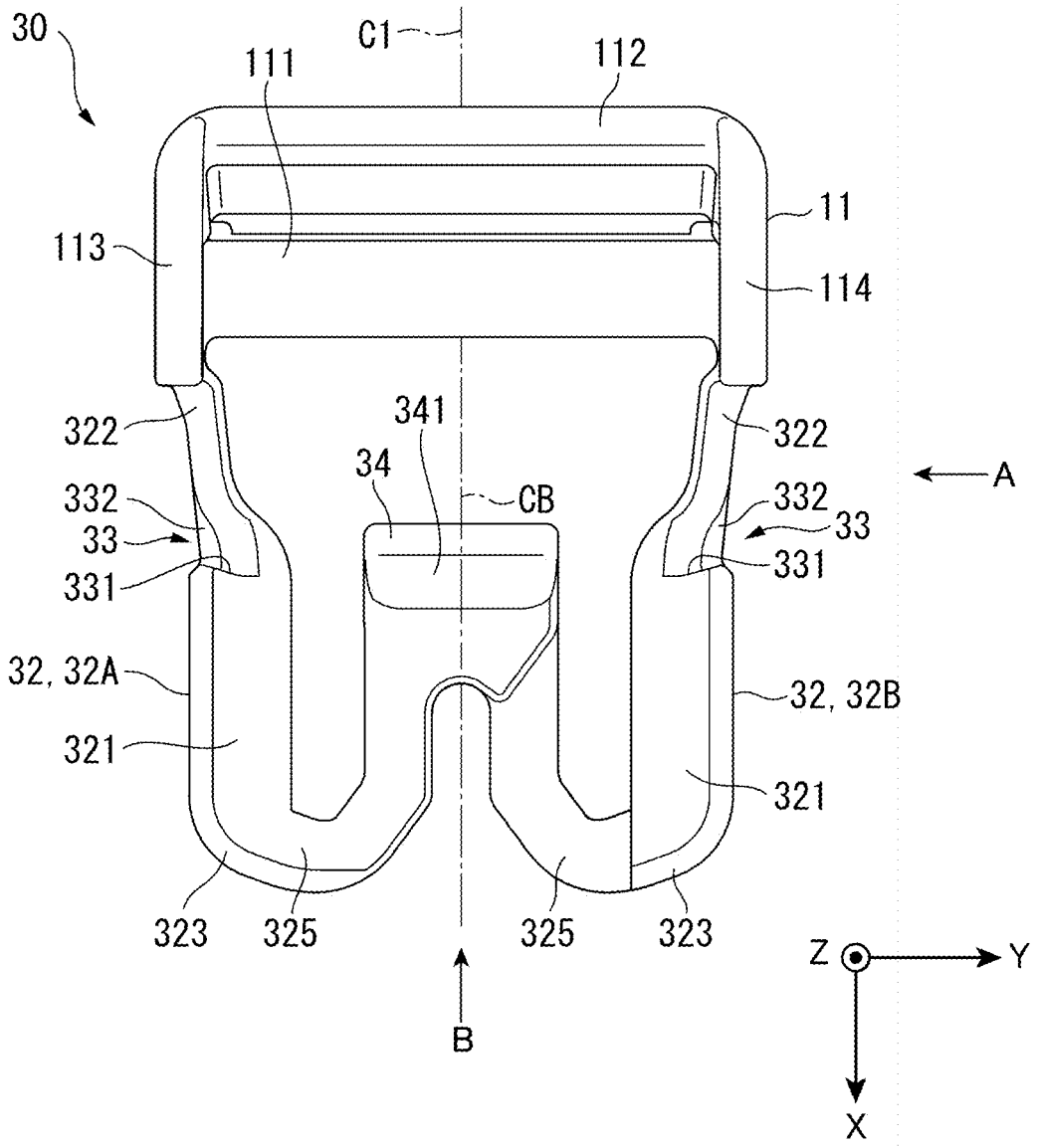
FIG. 10 is a front elevational view depicting a plug of the second exemplary embodiment.
Figure 11:
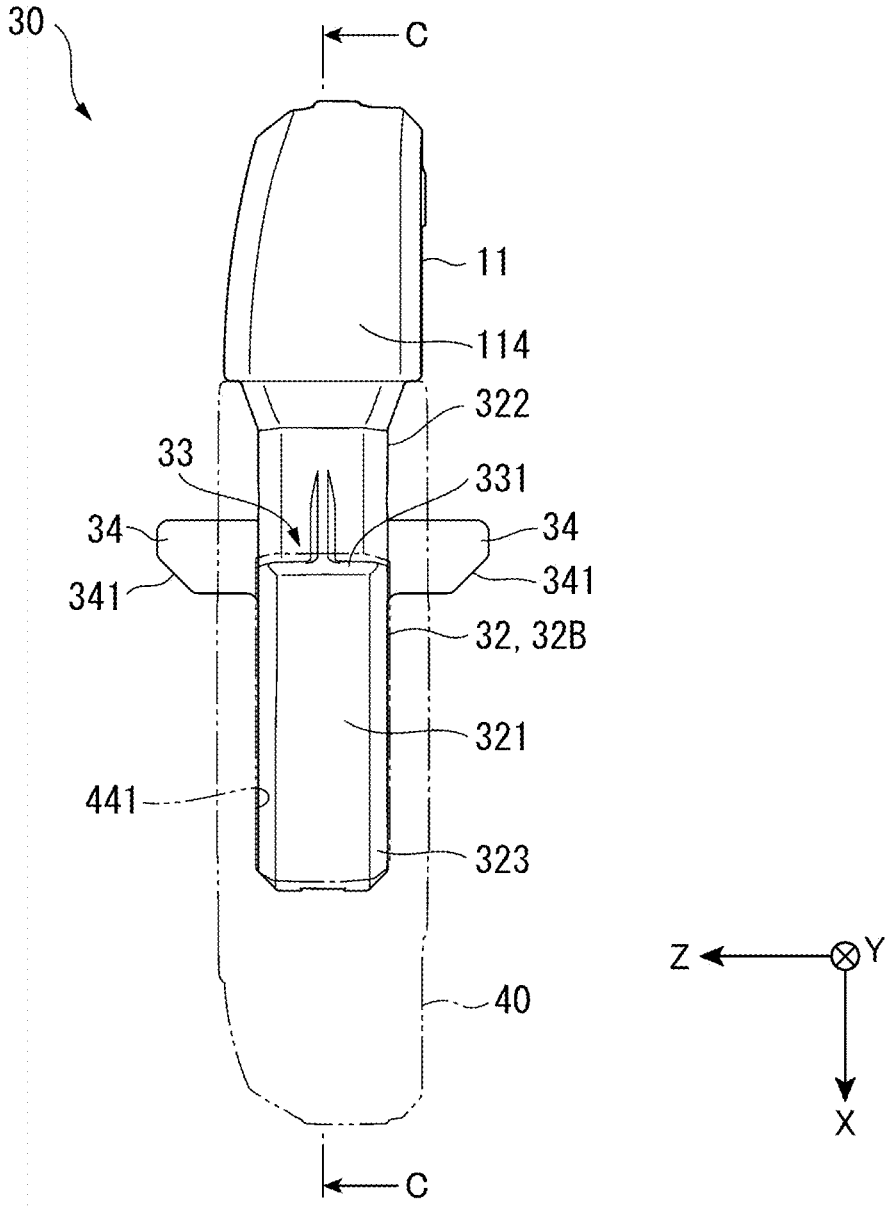
FIG. 11 is a side elevational view depicting the plug of the second exemplary embodiment seen in a direction of an arrow A in FIG. 10.
Figure 12:
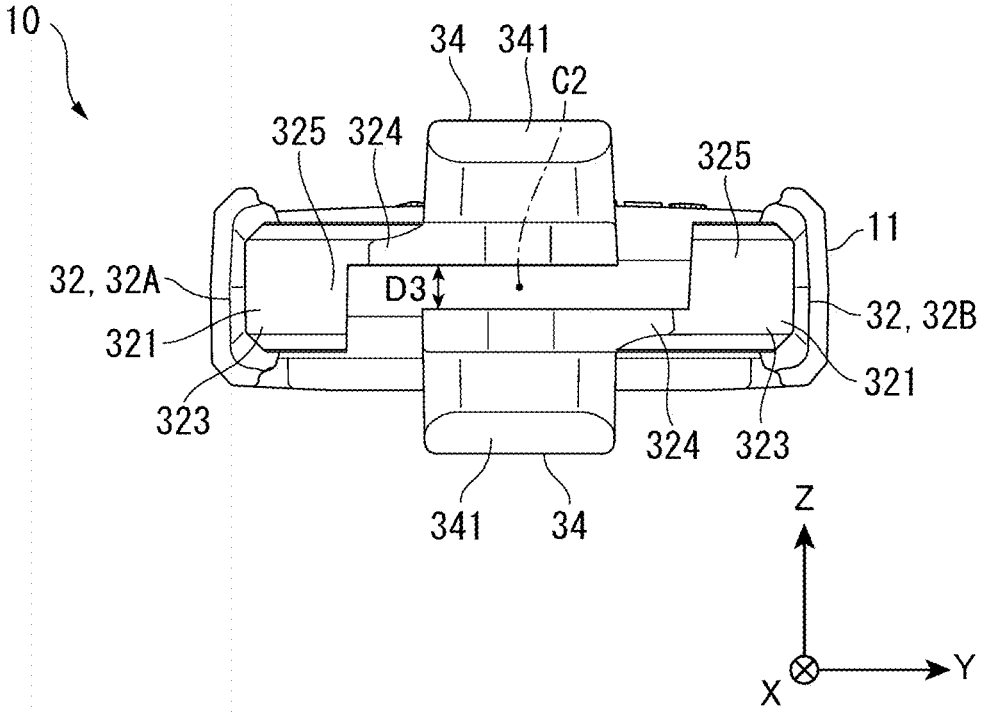
FIG. 12 is a side elevational view depicting the plug of the second exemplary embodiment seen in a direction of an arrow B in FIG. 10.
Figure 13:
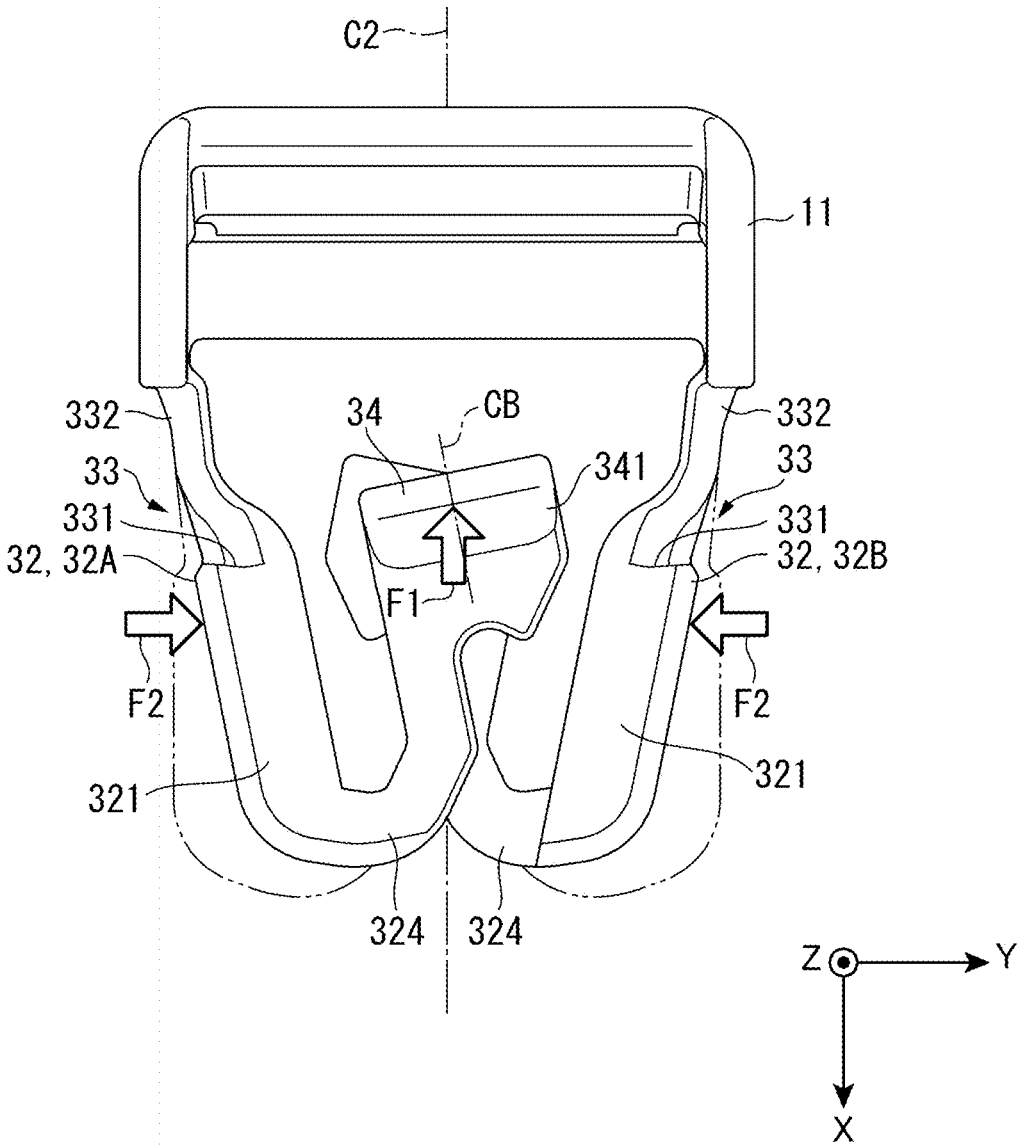
FIG. 13 depicts deformed legs of the plug of the second exemplary embodiment.
Figure 14:
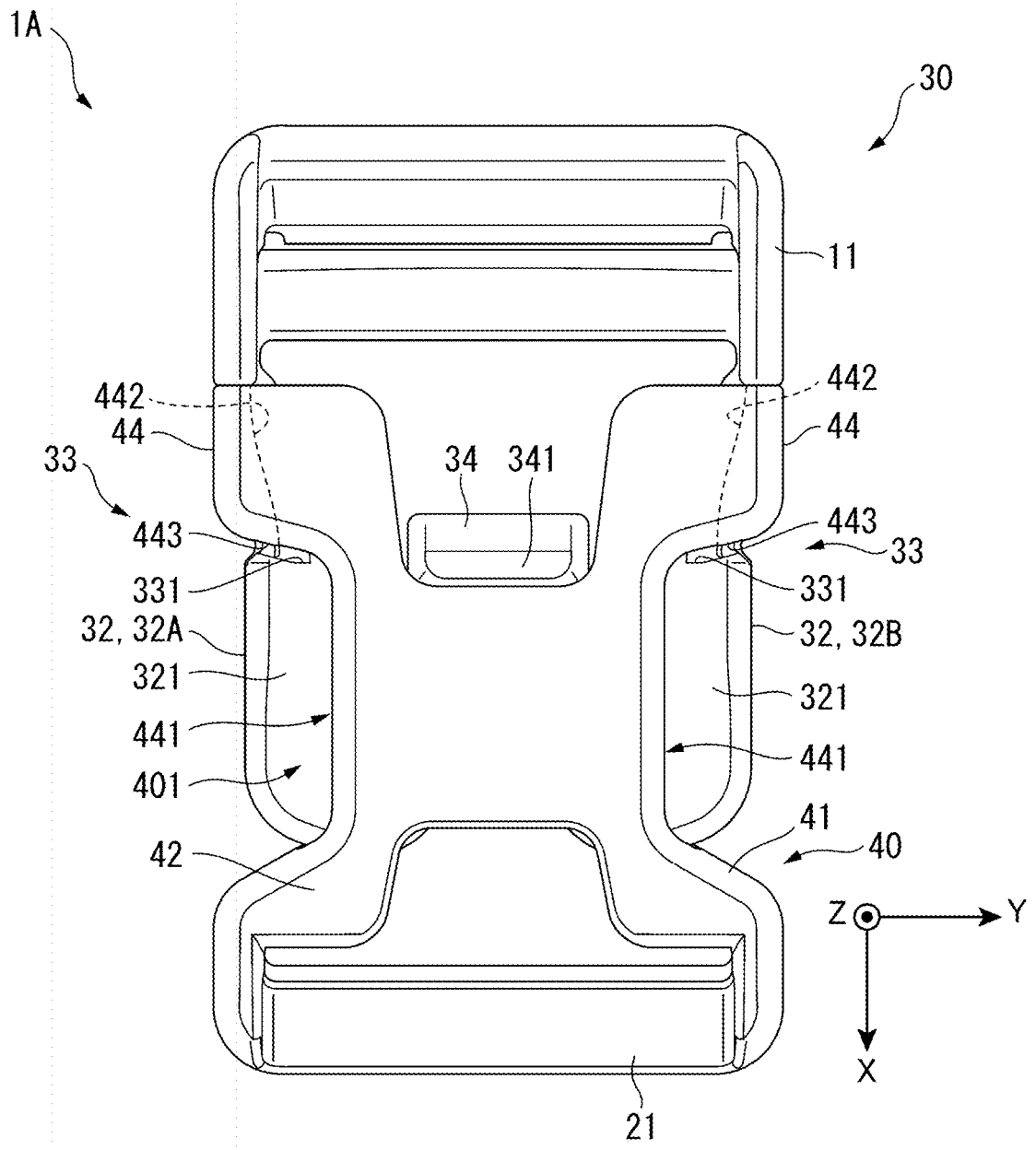
FIG. 14 is a front elevational view depicting the buckle of the second exemplary embodiment.

In order to connect the plug 30 and the socket 40, with the plug 30 and the socket 40 being aligned to face each other as shown in FIG. 9, a user inserts the plug 30 into the socket 40 through the insertion hole 411.

Figure 15:
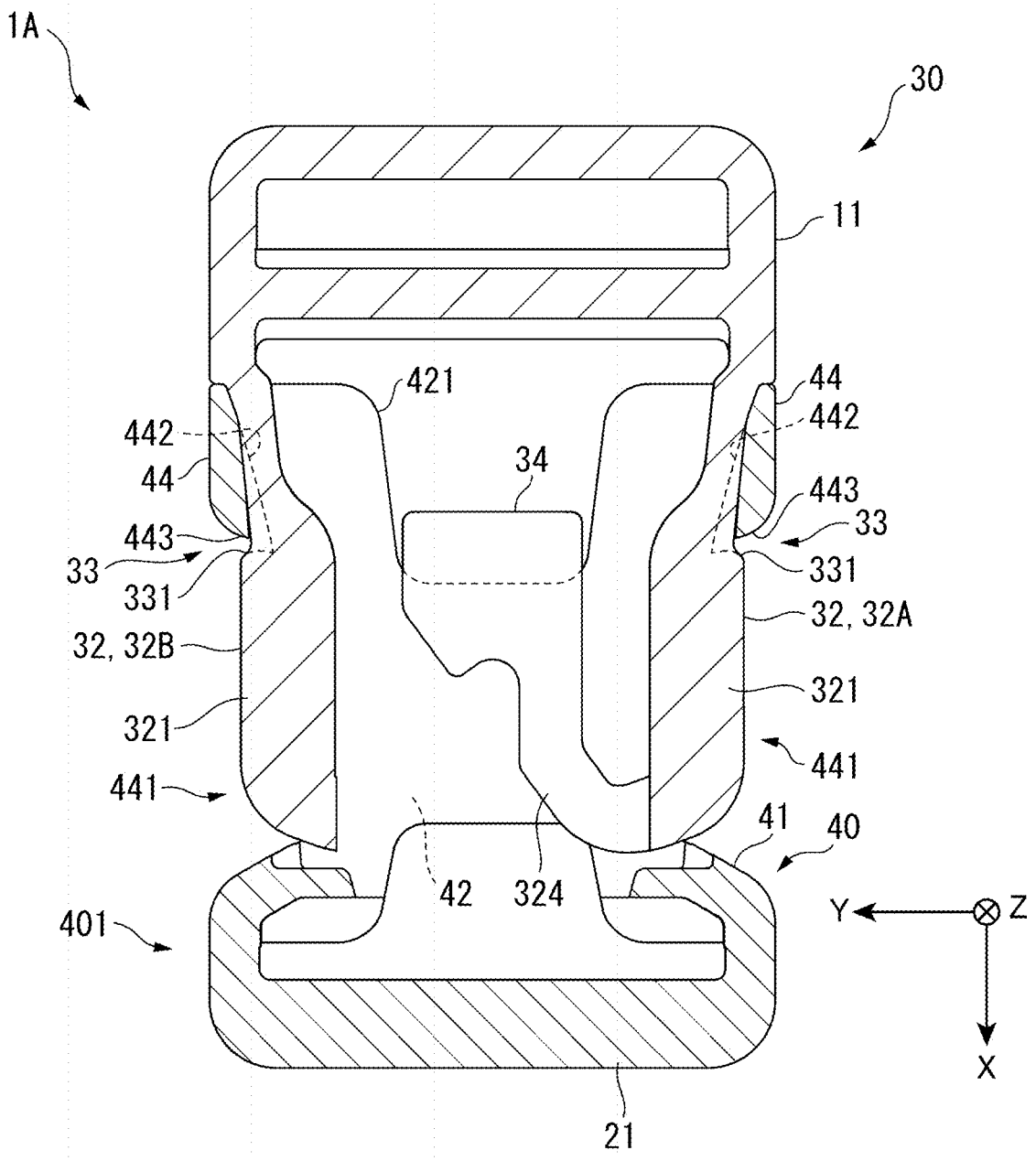
FIG. 15 is a cross-sectional view depicting the buckle of the second exemplary embodiment cut along C-C lines in FIG. 11.

When the leg 32 advances within the socket 40 in the X direction, the first extension 321 of the leg 32 is guided by the guide surface 442 of corresponding one of the lateral pieces 44 (see FIG. 15). Since the guide surface 442 of the lateral piece 44 herein is curved in the inward Y direction while being extended in the X direction, the first extension 321 receives pressure from the guide surface 442 to be elastically deformed in the inward Y direction. Then, when the engagement portion 33 reaches the to-be-engaged portion 443, the elastically deformed first extension 321 is restored to its original shape, where the engagement portion 33 is in contact and engaged with the to-be-engaged portion 443 in the −X direction.

The plug 30 is thus restricted from being moved in the −X direction (i.e. dropping off) to connect the plug 30 and the socket 40.

In the present exemplary embodiment, there are two options for an operation method for disconnecting (i.e. releasing the connection between) the plug 30 and the socket 40 as in the first exemplary embodiment.

In a first operation method, a user pinches the operation portions 34 of the pair of legs 32 from both sides in the Z direction and pulls the operation portions 34 in the −X direction. The force F1 in the −X direction is thus applied on the operation portions 34, so that the first extensions 321 of the pair of legs 32 are elastically deformed in the inward Y direction to disengage the engagement portion 33 of each of the legs 32 from the to-be-engaged portion 443. Then, the plug 30 is moved in the −X direction to be detached from the socket 40.

In a second operation method, a user pushes out the first extensions 321 of the pair of legs 32 in the −X direction while pressing the first extensions 321 in the inward Y direction. At this time, the force F2 in the inward Y direction is applied on the first extension 321, so that the first extensions 321 are elastically deformed in the inward Y direction to disengage the engagement portion 33 of each of the legs 32 from the to-be-engaged portion 443. Then, the plug 30 is moved in the −X direction to be detached from the socket 40.

It should be noted that, since the leg 32 of the plug 30 and the socket body 401 are each 180-degree rotationally symmetric around the center line, the plug 30 can be connected to and disconnected from the socket 40 even when the plug 30 is turned over.

As described above, the plug 30 of the present exemplary embodiment, which is different from the first exemplary embodiment in that the engagement portion 33 is provided on the first extension 321, still can achieve the same advantages as those in the first exemplary embodiment.

Third Exemplary Embodiment

Next, a third exemplary embodiment of the invention will be described below with reference to FIGS. 16 to 23.

Figure 16:
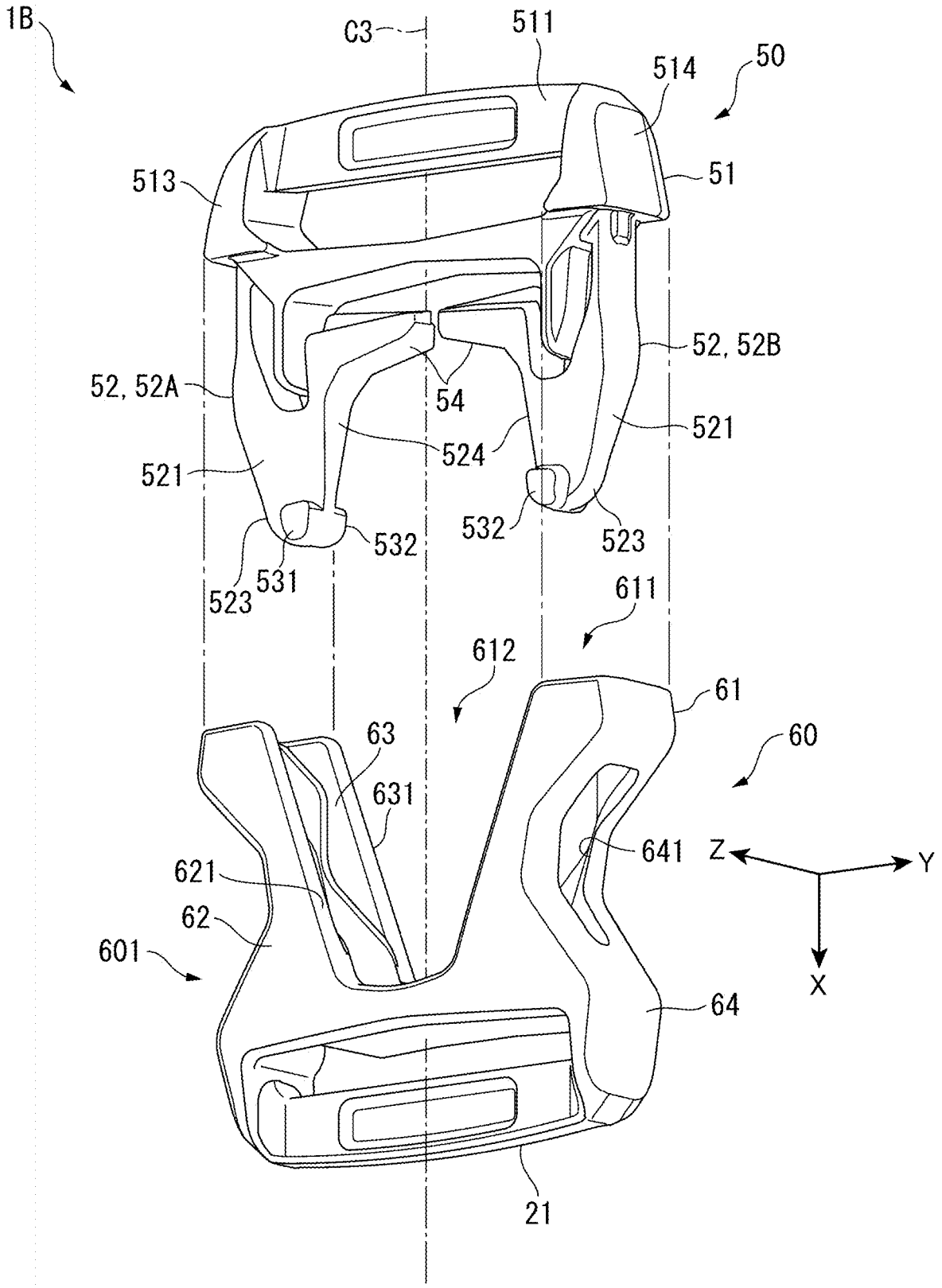
FIG. 16 is an exploded perspective view depicting a buckle according to a third exemplary embodiment of the invention.

As depicted in FIG. 16, a buckle 1B of the present exemplary embodiment includes a plug 50 and a socket 60 into which the plug 50 is insertable. The buckle 1B is different from the first exemplary embodiment mainly in terms of a configuration of an operation portion 54 of the plug 50. Description on the same or similar components as those in the first exemplary embodiment will be sometimes omitted hereinbelow.

Structure of Plug 50

A structure of the plug 50 will be described below with reference to FIGS. 16 to 20.

As depicted in FIGS. 16 to 20, the plug 50 includes a plug base 51 and a pair of legs 52A, 52B connected with the plug base 51.

The plug base 51 is provided with a stick-shaped member 511 arranged along the Y direction and a pair of lateral pieces 513, 514 connected with both Y-direction ends (i.e. ends in the Y direction) of the two stick-shaped member 511. A string member is wrapped around the stick-shaped member 511 to attach the string member to the plug base 51.

The pair of legs 52A, 52B are respectively connected to the pair of lateral pieces 513, 514 of the plug base 51 Specifically, the pair of legs 52A, 52B are connected to the plug base 51 at positions mutually spaced in the Y direction across a center line C3 of the plug 50.

Figure 17:
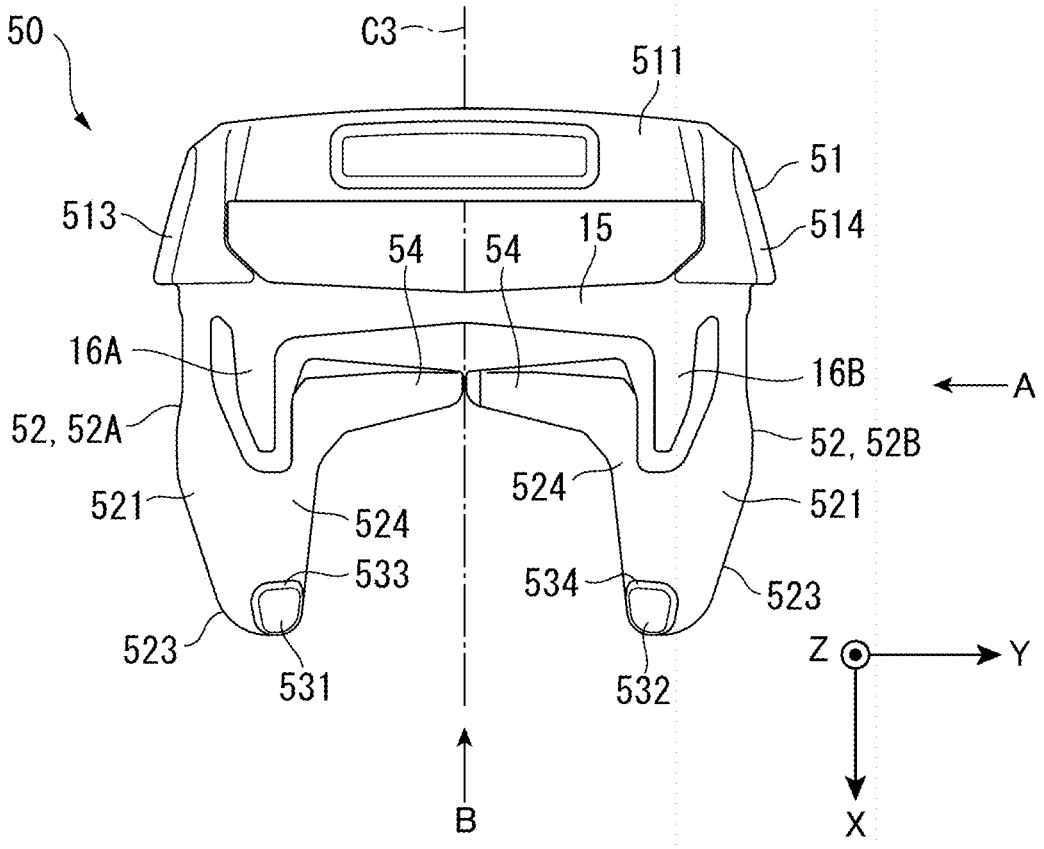
FIG. 17 is a front elevational view depicting a plug of the third exemplary embodiment.
Figure 18:
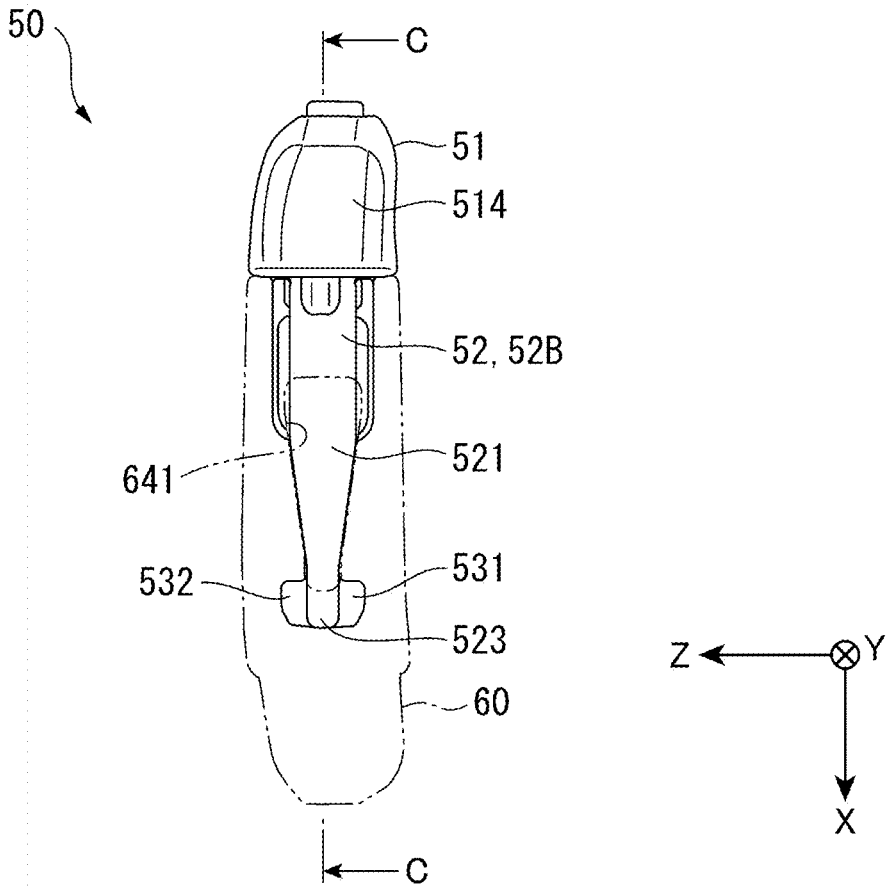
FIG. 18 is a side elevational view depicting the plug of the third exemplary embodiment seen in a direction of an arrow A in FIG. 17.
Figure 19:
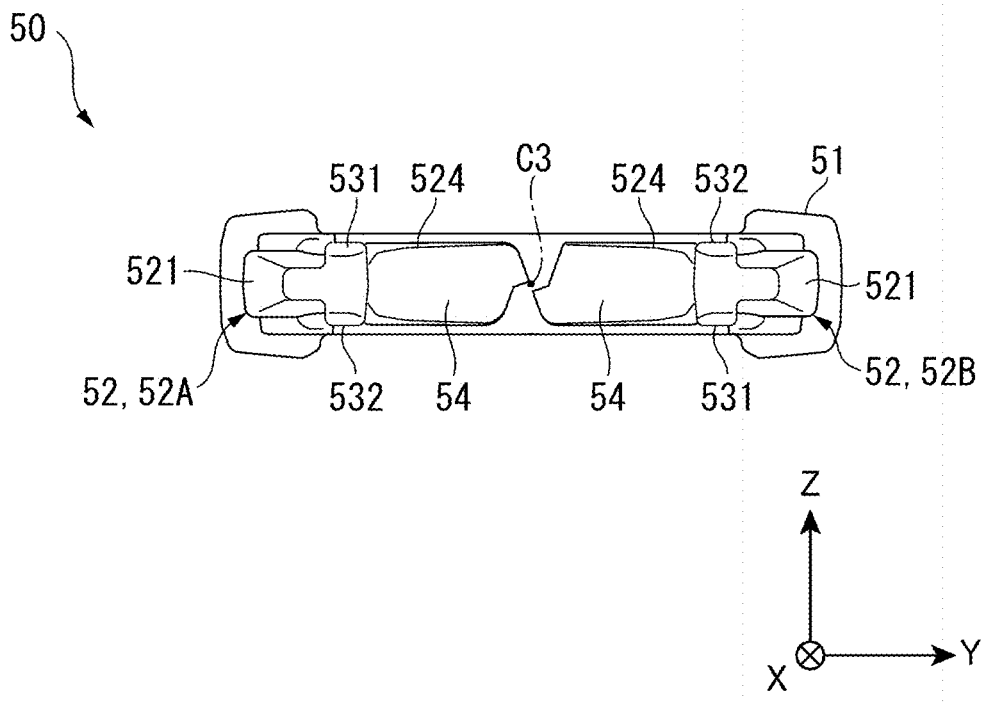
FIG. 19 is a side elevational view depicting the plug of the third exemplary embodiment seen in a direction of an arrow B in FIG. 17.

Further, the pair of legs 52A, 52B are 180-degree rotationally symmetric around the center line C3 of the plug 50. For instance, supposing that the plug 50 depicted in FIG. 17 is turned over, the pair of legs 52A, 52B are identically illustrated only except that the reference numerals 52A, 52B are exchanged.

Each of the legs 52A, 52B will be sometimes simply referred to as a leg 52 hereinafter for the convenience of collective description.

The leg 52 includes a first extension 521 extending from the plug base 51 in the X direction, a second extension 524 extending from the first extension 521 in the inward Y direction, and engagement portions 531, 532 and an operation portion 54 provided on the second extension 524.

The first extension 521, which is configured in the same manner as the first extension 121 of the first exemplary embodiment, is elastically deformable in the Y direction. It should be noted that the profiles of the first extension 521 before and after being elastically deformed are illustrated in dash-dotted lines and solid lines in FIG. 20, respectively.

The second extension 524, which is connected to an inward Y-direction side of an X-direction end of the first extension 521, is shaped to extend from the distal end portion in the −X direction and then in the inward Y direction after being curved It should be noted that the second extension 524 of the leg 52A is disposed at a first side in the Y direction with respect to the center line C3, whereas the second extension 524 of the leg 52B is disposed at a second side opposite the first side in the Y direction with respect to the center line C3. Further, the distal end portions of the second extensions 524 in the inward Y direction are spaced apart across a gap between the legs 52A, 52B to face each other in the Y direction. It should be noted that it is only necessary for the gap to be wide enough not to prevent the elastic deformation of the first extensions 521 of the legs 52A, 52B.

The engagement portions 531, 532, which are provided near an end of the second extension 524 in the X direction, protrude in the Z or −Z direction as in the engagement portions 131, 132 of the first exemplary embodiment.

The engagement portions 531, 532 are respectively provided with engaging surfaces 533, 534, which face the −X direction to be capable of being in contact with later-described to-be-engaged portions 643 of the socket 60 in the X direction.

The operation portion 54 is a part of the leg 52 operably exposed through a later-described socket body 601 and is operable by a user. The operation portion 54 is integrated with the second extension 524 in the present exemplary embodiment.

Specifically, the operation portion 54 is a part of the second extension 524 exposed from the socket body 601 through the slits 621, 631. The operation portions 54 of the leg 52A and the leg 52B are arranged in parallel across the center line C3 of the plug 50 to define an operation space OP together with peripheral portions of the slits 621, 631 (see FIG. 21).

Figure 20:
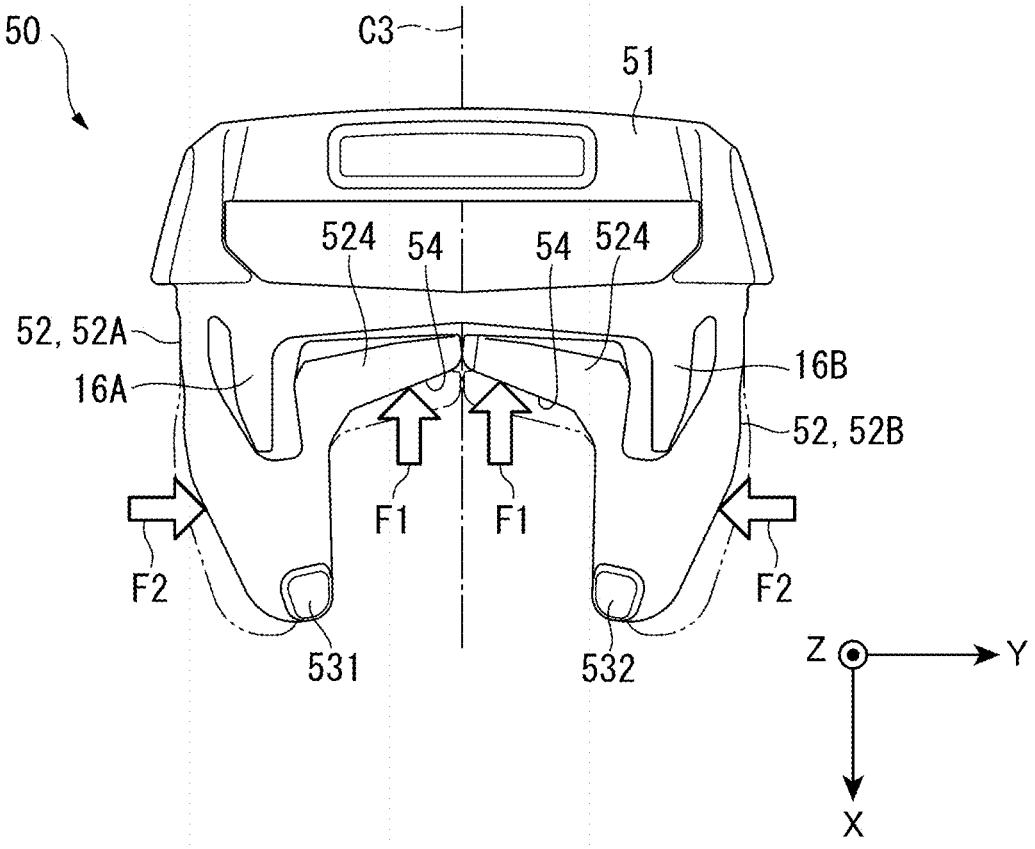
FIG. 20 depicts deformed legs of the plug of the third exemplary embodiment.
Figure 21:
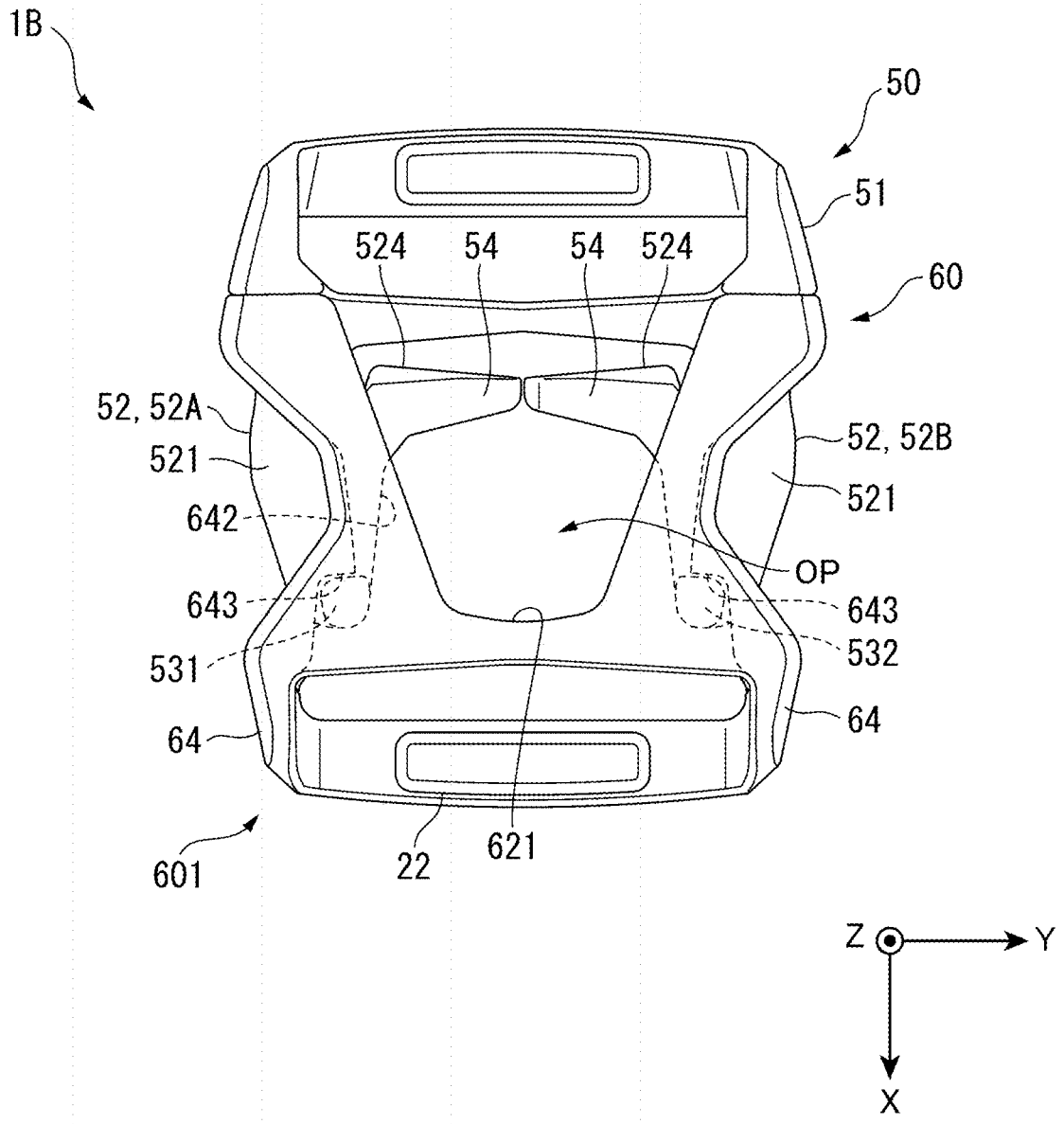
FIG. 21 is a front elevational view depicting the buckle of the third exemplary embodiment.

In order to disconnect the above-described plug 50 from the socket 60, an operation for applying a force F1 in the −X direction is performed on the operation portion 54 or an operation for applying a force F2 in the inward Y direction is performed on the first extension 521 (see FIG. 20).

When the force F1 in the −X direction is applied on the operation portion 54 or when the force F2 in the inward Y direction is applied on the first extension 521, the first extension 521 is elastically deformed in the inward Y direction to displace the engagement portions 531, 532 in the inward Y direction. Accordingly, the position of the engagement portion 531, 532 shifts from an engagement position to a disengagement position of the socket 60 with respect to the to-be-engaged portion 643.

Structure of Socket 60

Next, a structure of the socket 60 will be described below with reference to FIGS. 16 and 21 to 23.

The socket 60 includes the socket body 601, into which the pair of legs 52 of the plug 50 are inserted, and the stick-shaped member 21, which is substantially the same as that in the first exemplary embodiment.

The socket body 601 is arranged substantially in the same manner as the socket body 201 of the first exemplary embodiment. Specifically, the socket body 601 includes a front piece 62, a back piece 63, and a pair of lateral pieces 64. An insertion hole 611 for receiving the plug 50 is formed at a −X-direction end of the socket body 601 and a housing space 612 in communication with the insertion hole 611 is formed inside the socket body 601. In the housing space 612, the pair of legs 52 of the plug 50 inserted through the insertion hole 611 can be housed.

It should be noted that the socket body 601 is 180-degree rotationally symmetric around a center line of the socket 60 (coincident with the center line C3 of the plug 50 when the socket and the plug are connected) except for the shape of a part of the front piece 62 and the back piece 63.

The front piece 62 and the back piece 63 are respectively provided with slits 621, 631 defined in a form of a cut at a −X-direction end toward the X direction. While the plug 10 and the socket 20 are connected, the operation portion 54 defines the operation space OP with the peripheral portions of the slits 621, 631 as described above.

It should be noted that it is only necessary that at least one of the slit 621 of the front piece 62 and the slit 631 of the back piece 63 is formed in the present exemplary embodiment.

Each of the pair of lateral pieces 64 is curved to be dented in the inward Y direction. A hole 641 in communication with the housing space 612 is formed at the dented portion of each of the lateral pieces 64. When the plug 50 and the socket 60 are connected, a lateral surface of the first extension 521 in the outward Y direction is exposed through the hole 641 to an outside of the socket body 601.

An inner surface of each of the lateral pieces 64 defines a guide surface 642 continuous in the X direction at both of Z-direction and −Z-direction sides with respect to the hole 641. The guide surface 642 guides the engagement portions 531, 532 of the leg 52 toward the to-be-engaged portions 643 described below.

Two to-be-engaged portions 643 corresponding one-to-one to the engagement portions 531, 532 of the leg 52 are formed on the inner surfaces of the lateral pieces 64. Specifically, each to-be-engaged portion 643 facing the X direction is formed on the inner surface of each lateral piece 64 at an X-direction side of the guide surface 642.

When the plug 50 and the socket 60 are connected, the to-be-engaged portion 643 can be in contact with the engaging surface 533 (or 534) of the engagement portion 531 (or 532) of the leg 52.

Figure 22:
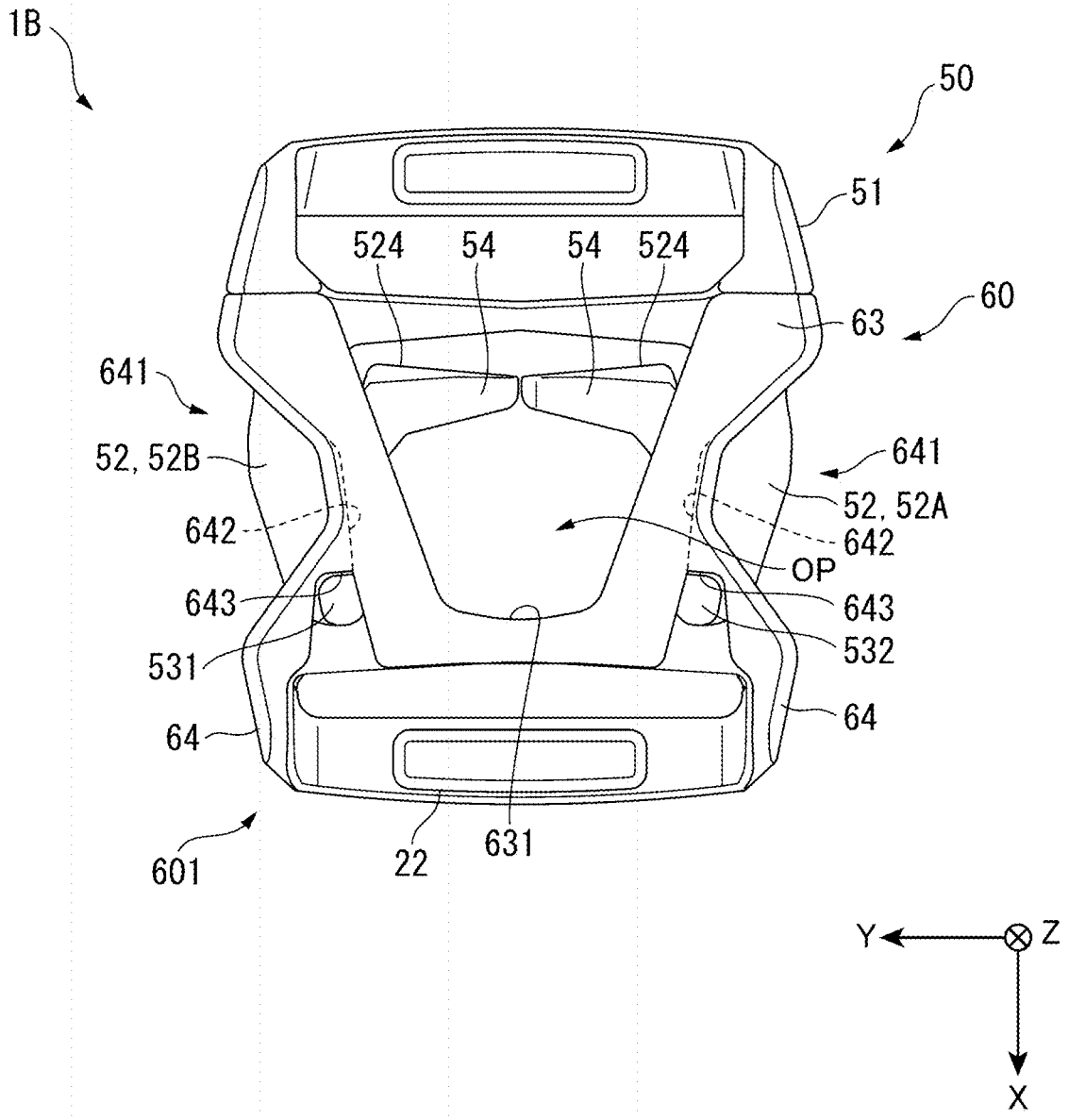
FIG. 22 is a rear elevational view depicting the buckle of the third exemplary embodiment.
Figure 23:
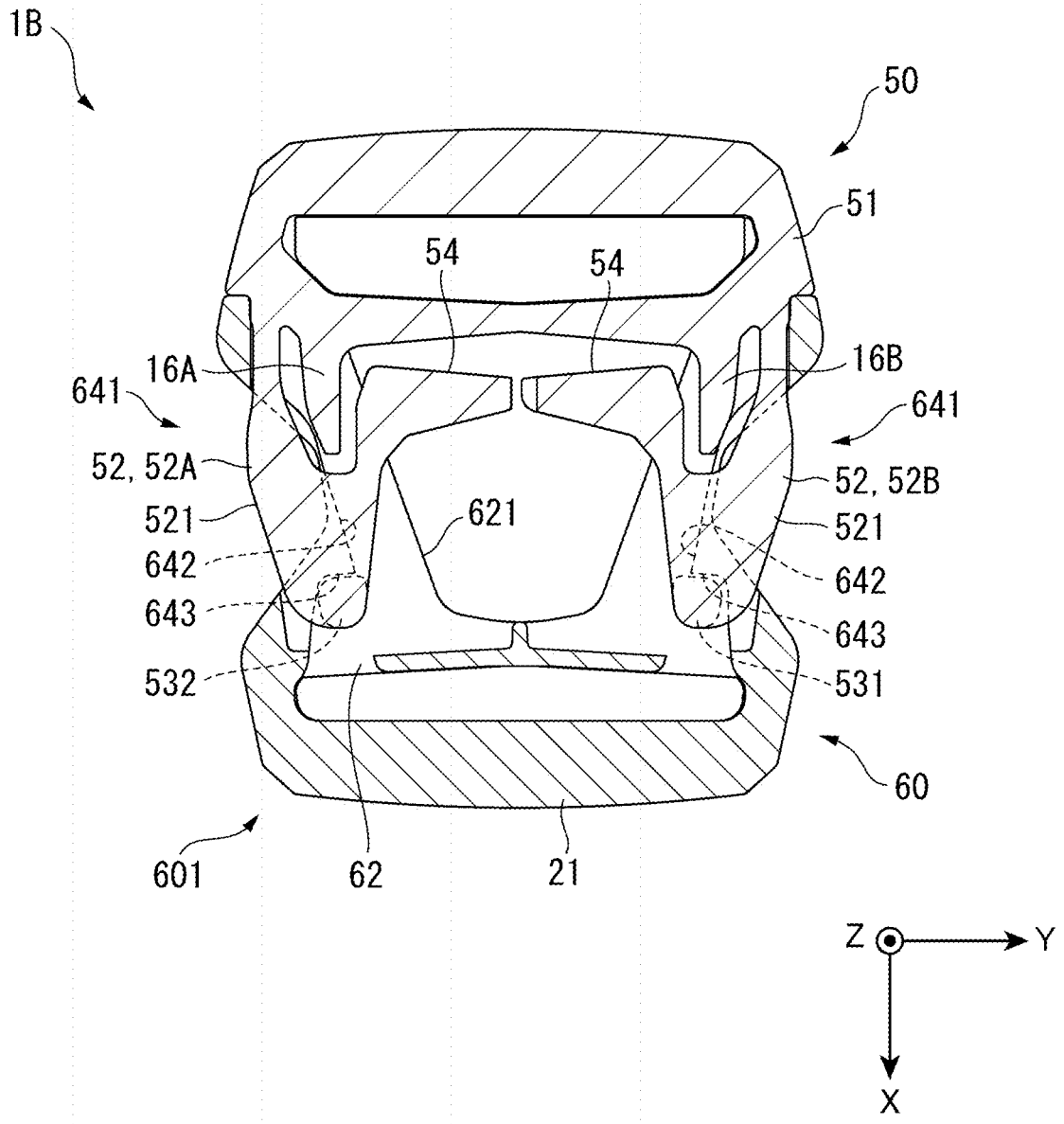
FIG. 23 is a cross-sectional view depicting the buckle of the third exemplary embodiment cut along C-C lines in FIG. 18.

It should be noted that, while the front piece 62 covers the to-be-engaged portion 643 located at the Z-direction side (see FIG. 21), the back piece 63 does not cover the to-be-engaged portion 643 located at the −Z direction side (see FIG. 22).

Connecting and Disconnecting Plug 50 and Socket 60

In order to connect the plug 50 and the socket 60, with the plug 50 and the socket 60 being aligned to face each other as shown in FIG. 16, a user inserts the plug 50 into the socket 60 through the insertion hole 611. The engagement portions 531, 532 are thus brought into contact and engaged with the to-be-engaged portion 643 in the −X direction as in the first exemplary embodiment, thereby connecting the plug 50 and the socket 60.

In the present exemplary embodiment, there are two options for an operation method for disconnecting (i.e. releasing the connection between) the plug 50 and the socket 60.

In a first operation method, a user puts a finger into the space OP and hooks the operation portions 54 of the pair of legs 52 with the finger to pull the operation portions 54 in the −X direction. The force F1 (see FIG. 20) in the −X direction is thus applied on the operation portions 54, so that the first extensions 521 of the pair of legs 52 are elastically deformed in the inward Y direction to disengage the engagement portions 531, 532 of each of the legs 52 from the to-be-engaged portion 643. Then, the plug 50 is moved in the −X direction to be detached from the socket 60.

In a second operation method, a user pushes out the first extensions 521 of the pair of legs 52 in the −X direction while pressing the first extensions 521 in the inward Y direction. At this time, the force F2 (see FIG. 20) in the Y direction is applied on the first extensions 521, so that the first extensions 521 are elastically deformed in the inward Y direction to disengage the engagement portions 531, 532 of each of the legs 52 from the to-be-engaged portions 643. Then, the plug 50 is moved in the −X direction to be detached from the socket 60.

It should be noted that, since the leg 52 of the plug 50 and the socket body 601 are each 180-degree rotationally symmetric around the center line, the plug 50 can be connected to and disconnected from the socket 60 even when the plug 30 is turned over.

As described above, the plug 50 of the present exemplary embodiment, which is different from the first exemplary embodiment in that the operation portions 54 are arranged in parallel in the Y direction, still can achieve the same advantages as those in the first exemplary embodiment.

Further, according to the plug 50 of the present exemplary embodiment, since the operation portion 54 does not protrude from the second extension 524, the buckle 1B can be made compact in the thickness direction.

Further, according to the first operation method of the buckle 1B using the plug 50 of the present exemplary embodiment, it is only necessary to put a finger into the space OP from one of the front side and the back side of the buckle 1B. Accordingly, the disengagement operation can be facilitated as compared with the first and second exemplary embodiments.

Modifications

The invention is not limited to the above-described exemplary embodiments but includes modifications and the like as long as such modifications and the like are compatible with an object of the invention.

In the above exemplary embodiments, the shapes of the operation portions 14, 34, 54 and the shapes of the slits 221, 421, 621 of the socket bodies 201, 401, 601 can be altered as desired.

Figure 24:
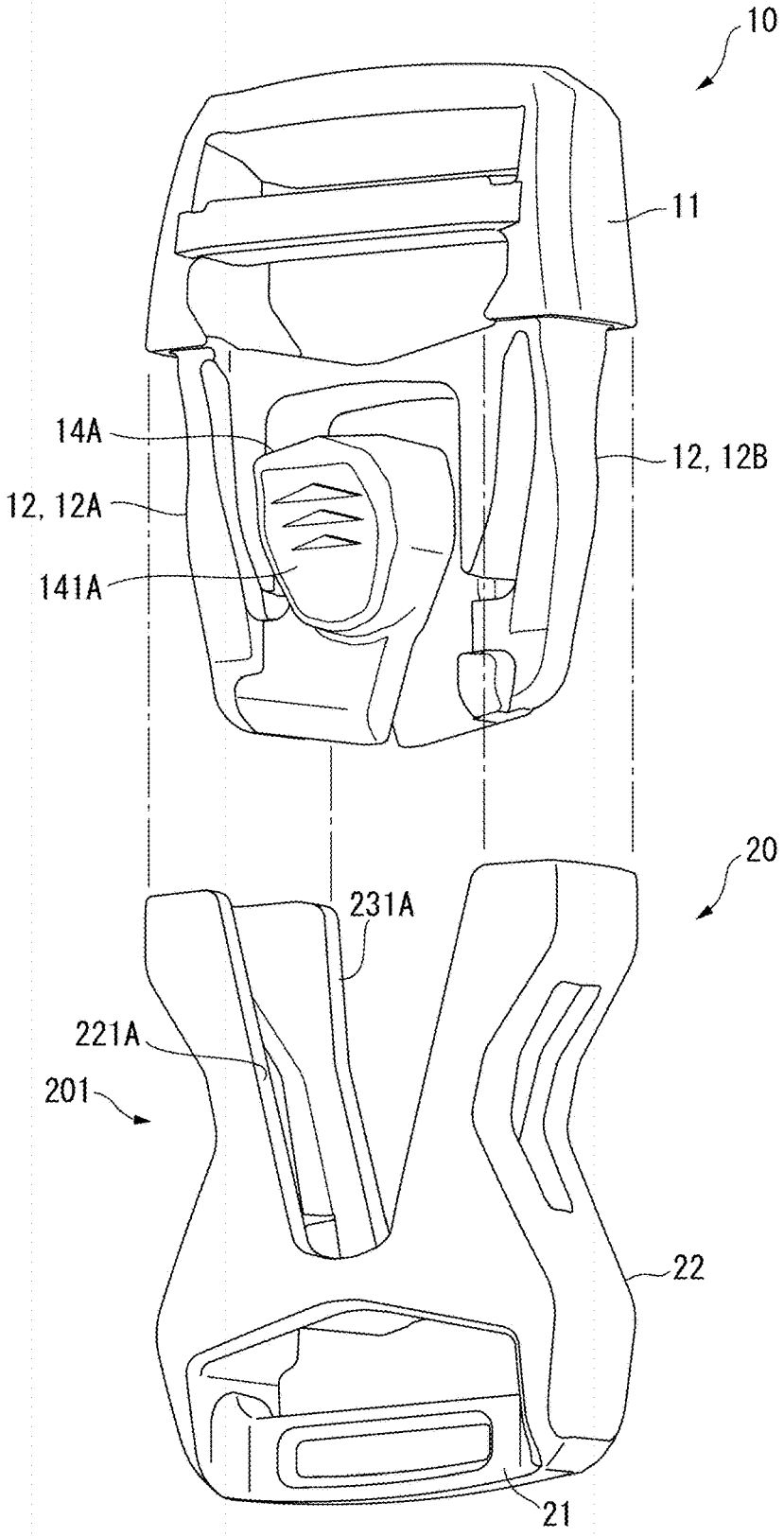
FIG. 24 is an exploded perspective view depicting a buckle according to a modification of the first exemplary embodiment.
Figure 25:
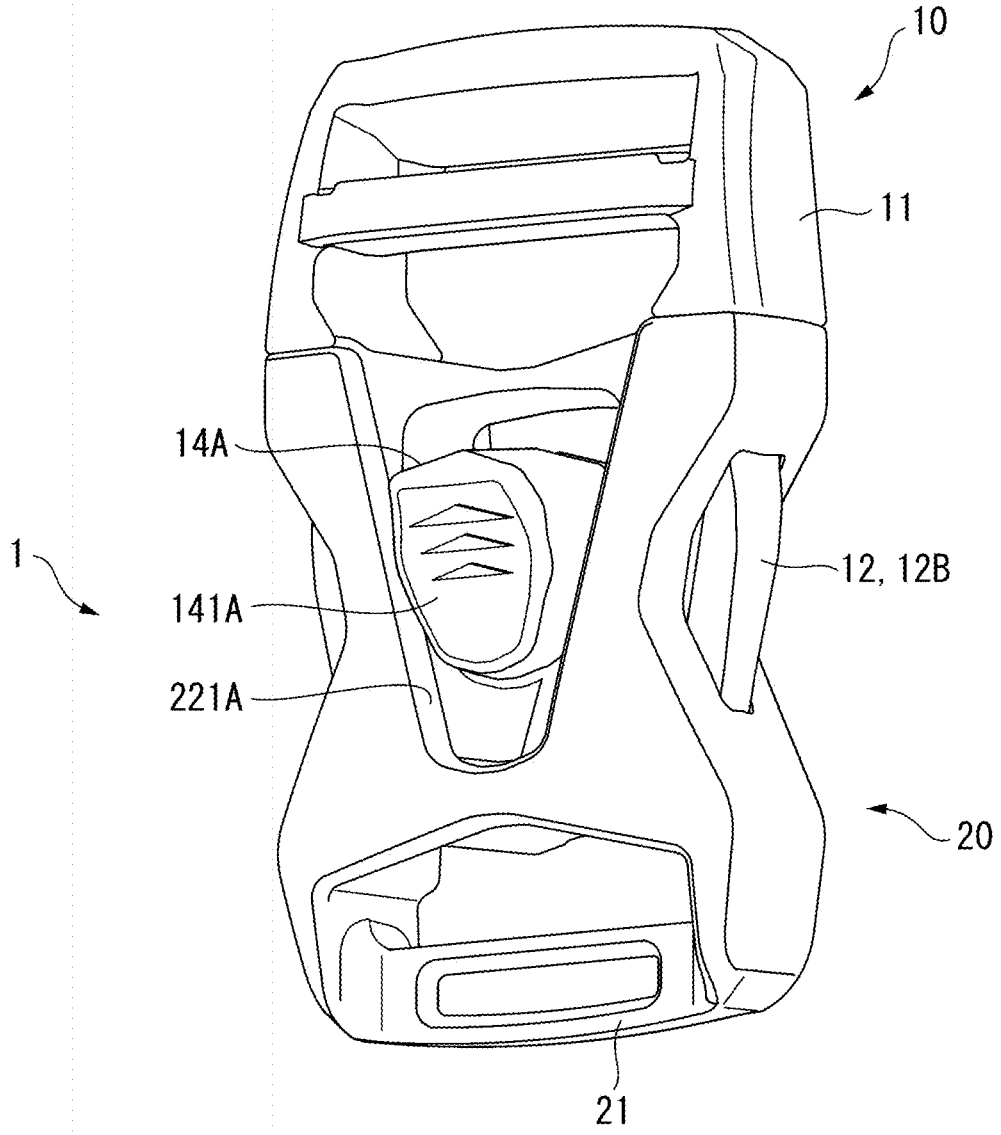
FIG. 25 is a front elevational view depicting the buckle according to the modification of the first exemplary embodiment.

For instance, a modification of the first exemplary embodiment is shown in FIGS. 24 and 25. In this modification, a slant surface 141A of an operation portion 14A is larger in size in the X direction than that in the first exemplary embodiment and is in a form of a button. The slit 221A, 231A of the socket body 201 are more deeply cut in the X direction than those in the first exemplary embodiment to fit to the shape of the operation portion 14A.

According to such a modification, since the slant surface 141A of the operation portion 14A is large in size, the operation for disconnecting the plug 10 and the socket 20 can be further facilitated.

Figure 26:
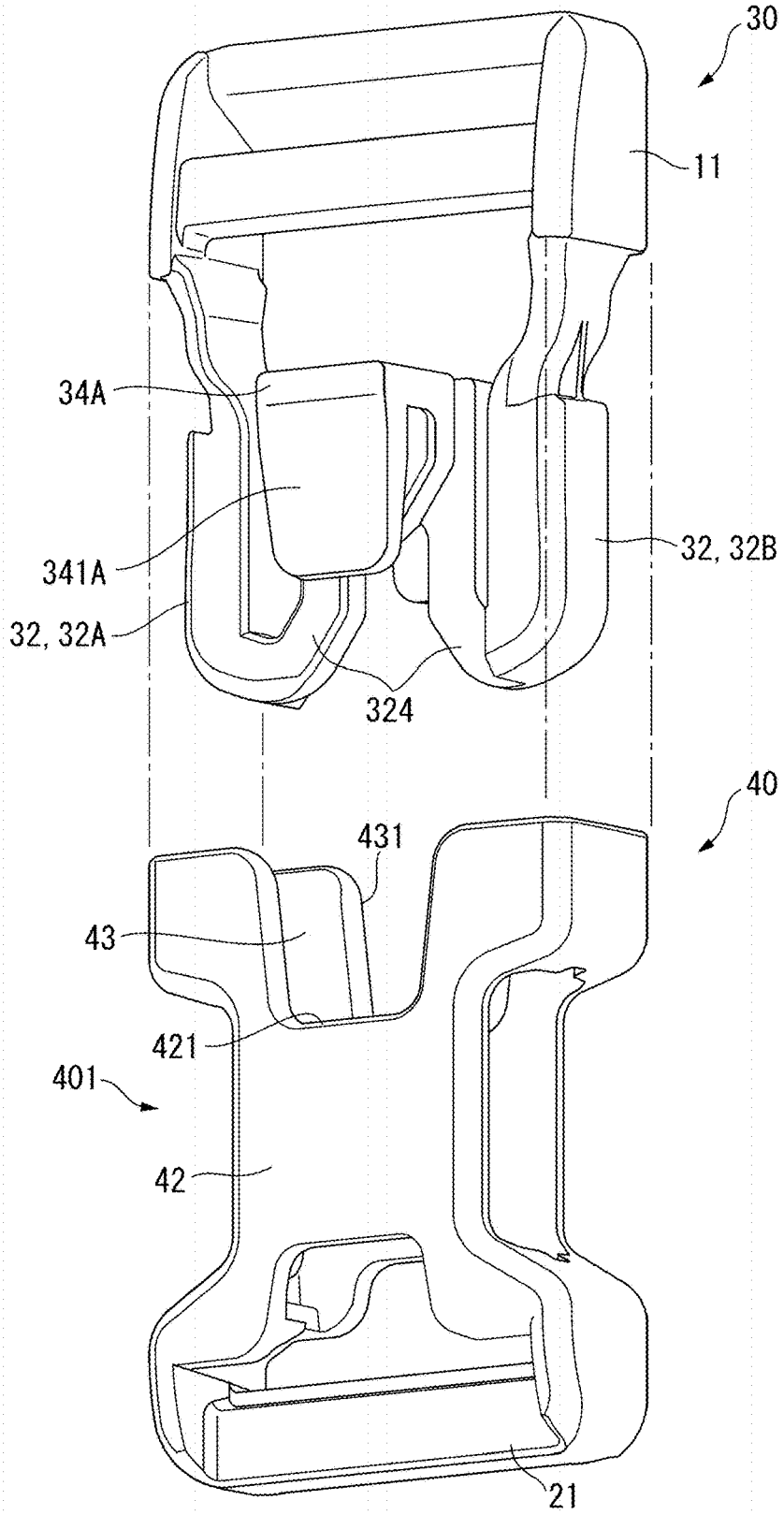
FIG. 26 is an exploded perspective view depicting a buckle according to a modification of the second exemplary embodiment.
Figure 27:
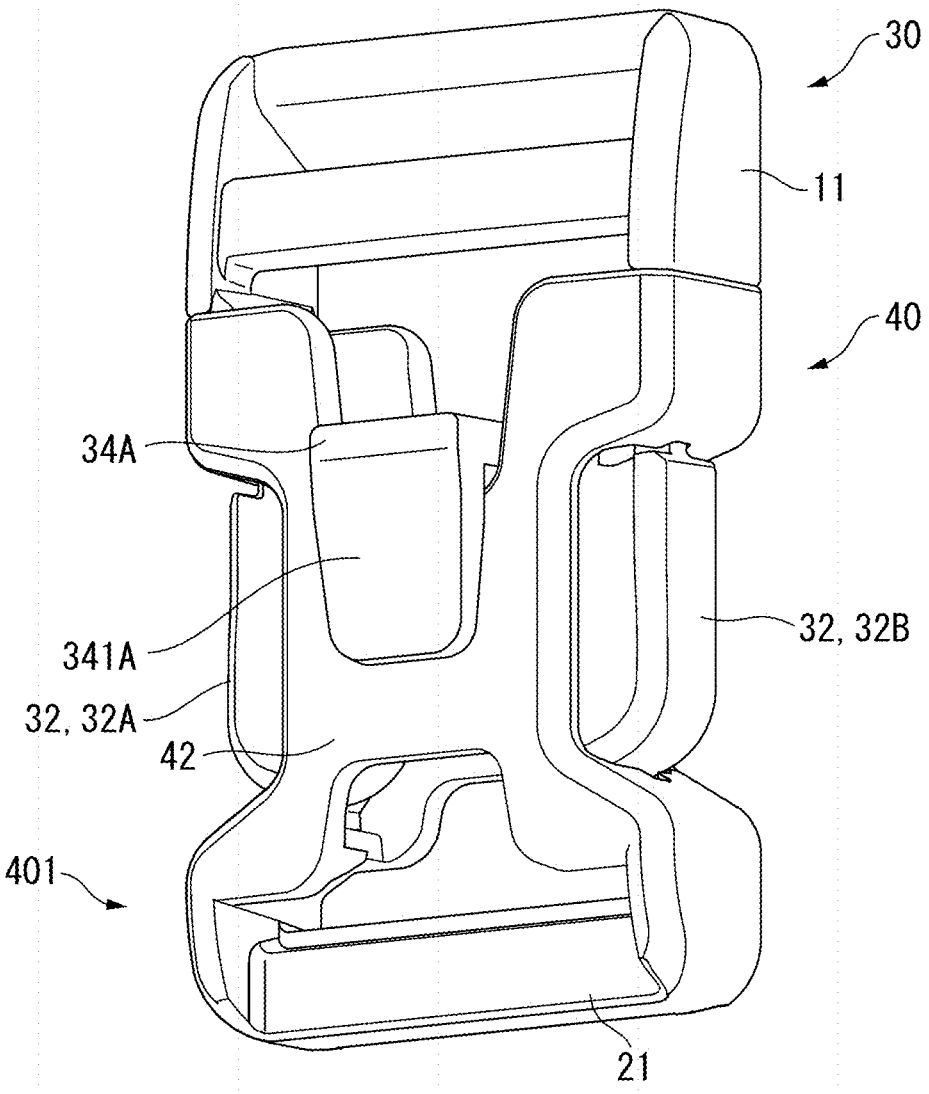
FIG. 27 is a front elevational view depicting the buckle according to the modification of the second exemplary embodiment.

A modification of the second exemplary embodiment is shown in FIGS. 26 and 27. In this modification, the second extension 324 of the leg 32 extends through the slit 421 (or 431) to an area above the front piece 42 (or the back piece 43) of the socket body 401. Accordingly, the operation portion 34A is located above the front piece 42 (or the back piece 43) of the socket body 401.

According to such a modification, the slant surface 341A of the operation portion 34A can be enlarged to overlap with the socket body 401 without enlarging the size of the slits 421, 431.

According to the first to third exemplary embodiments, the holes 241, 441, 641 in the socket bodies 201, 401, 601, respectively, are not necessarily formed.

Specifically, though the two options for the operation method for disconnecting the plugs 10, 30, 50 and the sockets 20, 40, 60 (i.e. the first operation method for applying the force F1 on the operation portions 14, 34, 54 and the second operation method for applying the force F2 on the first extensions 121, 321, 521) are described in the first to third exemplary embodiments, the invention is not necessarily configured as described above but it is only necessary that at least the first operation method is performed.

Accordingly, the variety of the design for the buckles 1, 1A, 1B can be enhanced.

Though the operation portions 14, 34 of the pair of legs 12, 32 protrude in the Z or −Z direction in the first and second exemplary embodiments, the invention is not necessarily configured as in the first and second exemplary embodiments.

For instance, when the operation portion 14 of the leg 12A of the first exemplary embodiment protrude in the Z direction, the operation portion 14 of the leg 12B may not protrude in the −Z direction but may be a part of the second extension 124 at least exposed from the socket body 201. In this case, a user pinches the operation portions 14 of the pair of legs 12 from both sides in the Z direction and pulls the operation portions 14 in the −X direction while pressing the operation portions 14 against each other between the pair of legs 12A, 12B. It should be noted that such a modification is also applicable to the second exemplary embodiment.

Though the engagement portions 131, 132, 531, 532 are each provided on the corresponding one of the second extensions 124, 524 in the first and third exemplary embodiments, an additional engagement portion is optionally provided on the first extensions 121, 521. Similarly, though the engagement portion 33 is provided on the first extension 321 in the second exemplary embodiment, an additional engagement portion is optionally provided on the second extension 324. The additional engagement portion is engageable with the corresponding one of the socket bodies 201, 401, 601 as in the engagement portions 131, 132, 33, 531, 532 and is disengageable from the corresponding one of the socket bodies 201, 401, 601 when a force is applied on the operation portions 14, 34, 54.

However, as described in the first to third exemplary embodiments, the engagement portions 131, 132, 33, 531, 532 are preferably provided on only one of the first extension 321 and the second extensions 124, 524, where the additional engagement portion is not required in the invention.

In the first to third exemplary embodiments, one of the legs 12, 32, 52 is optionally not provided with the engagement portions 131, 132, 33, 531, 532 and the operation portions 14, 34, 54.

For instance, when the leg 12A includes the engagement portions 131, 132 and the operation portion 14 in the first exemplary embodiment, the leg 12B is optionally not provided with the engagement portions 131, 132 and the operation portion 14 as long as the leg 12B at least includes the first extension 121. According to such a modification, engagement and disengagement of the plug 10 and the socket 20 are effected by the leg 12A, where the leg 12B is a component for assisting attitude control of the plug 10 within the socket body 201. It should be noted that such a modification is also applicable to the second and third exemplary embodiment.

The above-described exemplary embodiments and modifications of the invention are implemented in combination as needed.

The invention claimed is:

1. A plug insertable into and detachable from a socket, the plug and the socket constituting a buckle, the plug comprising:

a plug base; and a pair of legs connected to the plug base at respective positions mutually spaced apart in a width direction of the plug, wherein each one of the pair of legs comprises:

a first extension extending from the plug base in an insertion direction of the plug;

a second extension extending from the first extension in an inward width direction of the plug;

an engagement portion provided on the first extension or the second extension and being engageable with a to-be-engaged portion of the socket in a detachment direction of the plug; and an operation portion provided on the second extension, and when a force in the detachment direction is applied on both of the operation portions, the first extensions are mutually independently elastically deformed in the width direction of the plug in such a manner that positions of the engagement portions shift from engagement positions to disengagement positions with respect to the to-be-engaged portions.

2. The plug according to claim 1, wherein the operation portion of at least one of the pair of legs protrudes from the second extension in a thickness direction intersecting each of the insertion direction and the width direction of the plug.

3. The plug according to claim 2, wherein when the plug is seen in the thickness direction, the operation portions of the pair of legs are arranged to be mutually overlapped.

4. The plug according to claim 1, wherein each of the pair of legs comprises the first extension, the second extension, the engagement portion, and the operation portion, and the operation portions of the pair of legs are arranged in parallel in the width direction of the plug.

5. A buckle comprising: the plug according to claim 1; and the socket which the plug is insertable into and detachable from, wherein the socket comprises a socket body having a housing space in which the pair of legs are capable of being housed, the to-be-engaged portion being provided on the socket body, and with the socket body housing the pair of legs, the operation portion is operably exposed from the socket body.

6. The buckle according to claim 5, wherein the socket body comprises a front piece and a back piece facing each other across the housing space in a thickness direction intersecting each of the insertion direction and the width direction of the plug, and at least one of the front piece or the back piece has a slit for exposing the operation portion, the slit being cut in the insertion direction.

7. The buckle according to claim 5, wherein the socket body comprises a pair of lateral pieces facing each other across the housing space in the width direction of the plug, each of the lateral pieces having a hole for exposing the first extension.

* * * * *